US008637216B2

(12) United States Patent
Iwamoto et al.

(10) Patent No.: US 8,637,216 B2
(45) Date of Patent: Jan. 28, 2014

(54) ELECTROPHOTOGRAPHIC PHOTORECEPTOR, IMAGE FORMING APPARATUS AND PROCESS CARTRIDGE FOR IMAGE FORMING APPARATUS

(75) Inventors: Takafumi Iwamoto, Shizuoka (JP); Naohiro Toda, Kanagawa (JP); Chieko Yamazaki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 180 days.

(21) Appl. No.: 13/272,515

(22) Filed: Oct. 13, 2011

(65) Prior Publication Data

US 2012/0100473 A1 Apr. 26, 2012

(30) Foreign Application Priority Data

Oct. 25, 2010 (JP) ..... 2010-238837

(51) Int. Cl.
*G03G 5/00* (2006.01)

(52) U.S. Cl.
USPC ..... 430/66

(58) Field of Classification Search
USPC ..... 430/66
See application file for complete search history.

(56) References Cited

U.S. PATENT DOCUMENTS

2011/0076057 A1* 3/2011 Kami et al. ..... 399/159

FOREIGN PATENT DOCUMENTS

| | | |
|---|---|---|
| JP | 5-216249 | 8/1993 |
| JP | 2000-284514 | 10/2000 |
| JP | 2001-125286 | 5/2001 |
| JP | 3194392 | 6/2001 |
| JP | 2001-194813 | 7/2001 |
| JP | 2001-232954 | 8/2001 |
| JP | 2001-235887 | 8/2001 |
| JP | 2001-324857 | 11/2001 |
| JP | 2002-6526 | 1/2002 |
| JP | 3273258 | 2/2002 |
| JP | 2002-139859 | 5/2002 |
| JP | 2002-357914 | 12/2002 |
| JP | 2004-302451 | 10/2004 |
| JP | 2005-37562 | 2/2005 |
| JP | 2005-99688 | 4/2005 |
| JP | 2006-267859 | 10/2006 |
| JP | 2007-178815 | 7/2007 |
| JP | 3986019 | 7/2007 |
| JP | 4148505 | 4/2008 |
| JP | 2008-139824 | 6/2008 |
| JP | 2008-233893 | 10/2008 |
| JP | 4266859 | 2/2009 |
| JP | 2009-145480 | 7/2009 |
| JP | 4401599 | 11/2009 |

* cited by examiner

*Primary Examiner* — Mark A Chapman
(74) *Attorney, Agent, or Firm* — Cooper & Dunham LLP

(57) ABSTRACT

An electrophotographic photoreceptor including an electroconductive substrate, a photosensitive layer, and a cured protection layer, wherein the cured protection layer comprises a cured material of a tri- or more functional radical polymerizable compound and a filler exposed from the surface of the cured protection layer which comprises a bump along the surface of the filler, and wherein the cured protection layer has a thickness (T) larger than a diameter (2r) of the filler therein and the following relationships (a) is satisfied:

(the number of the fillers present to a depth of $T/2$ from a free surface of the cured protection layer/ the total number of the fillers in the cured protection layer)×100≥7% (a).

13 Claims, 6 Drawing Sheets

ELECTROPHOTOGRAPHIC PHOTORECEPTOR, IMAGE FORMING APPARATUS AND PROCESS CARTRIDGE FOR IMAGE FORMING APPARATUS

CROSS-REFERENCE TO RELATED APPLICATIONS

This patent application is based on and claims priority pursuant to 35 U.S.C. §119 to Japanese Patent Application No. 2010-238837, filed on Oct. 25, 2010, in the Japanese Patent Office, the entire disclosure of which is hereby incorporated herein by reference.

FIELD OF THE INVENTION

The present invention relates to an electrophotographic photoreceptor having both of mechanical durability and releasability (foreign particles are difficult to adhere to), and an image forming apparatus and a process cartridge therefor using the photoreceptor.

BACKGROUND OF THE INVENTION

Recently, organic photoreceptors have been mostly used for electrophotographic photoreceptor (hereinafter referred to as a photoreceptor). The organic photoreceptors have more advantages than inorganic photoreceptors in that materials capable of receiving various light from visible light to infrared can be used, materials which are less influenced by environmental contamination can be used, and that inexpensive materials can be used. However, the organic photoreceptors have a disadvantage of poorer mechanical durability than the inorganic ones. In terms of effective use of resources, photoreceptors preferably have sufficient mechanical durability and long lives. Therefore, for the purpose of increasing mechanical durability of the organic photoreceptors, a number of arts forming a protection layer are disclosed. However, it is difficult for the organic photoreceptors to have long lives only by increasing the mechanical durability. Prevention of adherence of foreign particles and improvement of toner transferability are essential therefor to have long lives.

Even photoreceptors having good mechanical durability occasionally produce abnormal images when used for long periods due to paper powders and adherence of toner additives. A part of the photoreceptor these adhere to is not properly charged or irradiated, resulting in production of abnormal images. Photoreceptors having poor mechanical durability can prevent production of abnormal images because outermost surfaces thereof are abraded and new surfaces consecutively appear. However, they are difficult to have long lives. Therefore, it is very important to prevent adherence of foreign particles.

Toners do not waste when having higher transferability. When untransferred toner (toner remaining on a photoreceptor even after transferred onto a paper or an intermediate transferer) increases, a cleaner does not work well, resulting in shorter life of a process cartridge.

It is very important as well to increase transferability of a toner. Prevention of adherence of foreign particles and improvement of toner transferability are referred to as releasability in combination because of representing the same repellency.

A mechanical durability improver and a releasability applicator need to be combined to have both of mechanical durability and releasability, but which is not easy.

A number of arts forming a protection layer on the outermost surface of a photoreceptor and dispersing an inorganic particulate material in the protection layer to improve mechanical durability of the photoreceptor are disclosed.

Japanese published unexamined application No. 2002-139859 discloses an electrophotographic photoreceptor including at least an electroconductive substrate, a photosensitive layer overlying the substrate, and a protection layer including a filler and overlying the photosensitive layer.

Further, a number of methods increasing hardness of the surface of a photoreceptor are disclosed as well. Japanese published unexamined applications Nos. 2001-125286 and 2001-324857 disclose increasing hardness of a protection layer of a photoreceptor to prevent a magnetic particulate material transferred onto the photoreceptor from damaging the photoreceptor when pressed by a transferer or a cleaner thereto when a magnetic brush is used as a charger.

Japanese published unexamined application No. 2003-098708 disclose increasing hardness of a photoreceptor to prevent the surface thereof from being abraded when a blade cleaner is used. Specific means of increasing hardness of the surface of a photoreceptor include including crosslinkable materials such as thermosetting resins and UV curing resins in a protection layer of the photoreceptor. Japanese published unexamined applications Nos. 5-181299, 2002-6526 and 2002-82465 disclose methods of using a thermosetting resin as a binder of a protection layer to improve mechanical durability and damage resistance thereof.

Japanese published unexamined applications Nos. 2000-284514, 2000-284515 and 2001-194813 disclose including a siloxane resin bonded with a charge transportability imparting group in a protection layer to improve mechanical durability and damage resistance thereof.

Japanese patent No. 3194392 discloses a method of forming a charge transport layer using a monomer having a carbon-carbon double bond, a charge transport material having a carbon-carbon double bond, and a binder resin to improve mechanical durability and damage resistance of the charge transport layer.

Japanese published unexamined application No. 2004-302451 discloses a method of hardening a tri- or more functional radical polymerizable monomer having no charge transport structure and a monofunctional radical polymerizable compound having a charge transport structure to form a charge transport layer.

Further, Japanese published unexamined application No. 2005-99688 discloses a method of hardening a tri- or more functional radical polymerizable monomer having no charge transport structure and a monofunctional radical polymerizable compound having a charge transport structure, and further dispersing a filler to form a protection layer. These methods noticeably improve mechanical durability of a photoreceptor. Particularly, photoreceptors including a curing resin disclosed in Japanese published unexamined applications Nos. 2004-302451 and 2005-99688 have good mechanical durability and damage resistance.

The outermost surface effectively has a lower energy to impart releasability thereto. A low surface energizer may externally coated on or internally included in a layer to low surface energize the surface of a photoreceptor. As an external additive, zinc stearate is typically coated thereon to impart releasability thereto. However, the low surface energizer deteriorates due to discharge, resulting in production of abnormal images. Further, a low surface energizer applicator enlarges an image forming unit and lowers layout flexibility, and the cost of the image forming unit increases. The low surface energizer is effectively included in a layer to improve the releasability thereof as well.

Japanese published unexamined application No. 2007-178815 discloses a photoreceptor including a fluorine-substituted polysiloxane resin in its surface layer to impart high releasability to the surface thereof. However, a siloxane bond is known to cause polarization and hydrogen bond. Therefore, the siloxane bond adheres to a toner more and the reliability deteriorates under high humidity. Further, in order to expose a low surface energizer on the surface, the surface of a photoreceptor is constantly abraded, and therefore mechanical durability thereof is sacrificed.

Japanese published unexamined application No. 2002-006526 discloses a photoreceptor including a lubricating particulate material in its protection layer.

Japanese published unexamined application No. 2008-139824 discloses a photoreceptor having a surface protection layer formed of a hardened fluorine-containing light curing composition including a (meth)acylate including a fluorinated alkyl group and a photopolymerization initiator.

Japanese published unexamined application No. 2008-233893 discloses a photoreceptor having a crosslinked surface layer formed by hardening a fluorine UV curing hard coat agent and a monofunctional radical polymerizable compound having a charge transport structure, and further including a lubricating particulate material therein. The fluorine material effectively decreases adherence between a photoreceptor and a toner. Particularly when included in a hardened protection layer, the photoreceptor has high mechanical durability and lower adherence to a toner. However, the protection layer needs to include a large amount of the fluorine materials to sufficiently decrease the adherence. The fluorine materials having no charge transport structure increases a bright space potential when included in a large amount. It is thought this is due to hindrance of charge transport in a layer or in an interface between a charge transport layer and a protection layer. Further, a releasing material tends to decrease film strength. Namely, the releasing material is preferably present only at the surface of a photoreceptor.

As a method of making the releasing material present only at the surface of a photoreceptor, Japanese published unexamined application No. 2005-037562 discloses preparing a photoreceptor with a coating liquid including a large amount of fluorine-containing particulate resins. This imparts releasability to the surface of a photoreceptor, but the surface needs to be abraded such that the fluorine-containing particulate resins are exposed. Therefore, mechanical durability of the photoreceptor is sacrificed.

Japanese published unexamined application No. 2006-267859 discloses a method of forming a hardened surface layer, and then burying a particulate material therein. This can bury the particulate material only at the surface of a photoreceptor. However, a circumference of the particulate material buried does not have a structure engulfing the particulate material. Therefore, the particulate material has a small retaining force and is quickly released, resulting in discontinuation of releasability.

Japanese published unexamined application No. 2009-145480 discloses a method of migrating a lubricating filler at the surface of a surface layer after coated. The filler is engulfed by a hardened protection layer. However, the hardened protection layer has small crosslink density, and therefore has a low mechanical durability. Namely, even the lubricating filler is difficult to maintain releasability.

Japanese published unexamined application No. 2002-357914 discloses a method of coating plural filler dispersions to include 2 fillers in a protection layer with a concentration gradient for each in a direction of thickness. This can possibly make the fillers having different properties from each other develop each of their properties. However, most of the fillers are coated by the protection layer. Therefore, even when a filler having releasability is included, releasability is not fully exerted occasionally.

Japanese published unexamined application No. 2001-2323954 discloses a protection layer, from the surface of which at least two fillers project. A filler having a particle diameter larger than a thickness of the protection layer is included in a coating liquid to form the filler projected from the surface thereof. Such a coating liquid tends to form a nonuniform film. Further, the thickness of a protection layer limits a particle diameter of the filler. Since the filler projects while coating, a large area of the filler is coated with resins in the coating liquid and does not sufficiently exert its effect. In addition, the projection of the filler is difficult to control. Japanese published unexamined application No. 2001-235887 discloses a filler projecting from the outermost surface. However, the filler is not fixed well and an amount thereof is too small to exert its effect for long periods.

Therefore, releasing materials need to be gathered near the surface, exposed and kept as they are. However, arts maintaining such conditions for long periods have not been established.

As just described, photoreceptors are difficult to have both high mechanical durability and high releasability, and can have only one of them now.

Because of these reasons, a need exists for an electrophotographic photoreceptor having both high mechanical durability and high releasability, and stably producing high-quality images for long periods even after repeatedly used for long periods.

SUMMARY OF THE INVENTION

Accordingly, an object of the present invention is to provide an electrophotographic photoreceptor having both high mechanical durability and high releasability, and stably producing high-quality images for long periods even after repeatedly used for long periods.

Another object of the present invention is to provide an image forming apparatus using the photoreceptor.

A further object of the present invention is to provide a process cartridge for image forming apparatus, using the photoreceptor.

These objects and other objects of the present invention, either individually or collectively, have been satisfied by the discovery of an electrophotographic photoreceptor, comprising:

an electroconductive substrate;

a photosensitive layer, overlying the substrate; and a cured protection layer, overlying the photosensitive layer, wherein the cured protection layer comprises a cured material of a tri- or more functional radical polymerizable compound and a filler exposed from the surface of the cured protection layer which comprises a bump along the surface of the filler, and wherein the cured protection layer has a thickness (T) larger than a diameter (2r) of the filler therein and the following relationships (a) is satisfied:

$$(\text{the number of the fillers present to a depth of } T/2 \text{ from a free surface of the cured protection layer/ the total number of the fillers in the cured protection layer})\times 100 \geq 7\% \quad \text{(a).}$$

These and other objects, features and advantages of the present invention will become apparent upon consideration of the following description of the preferred embodiments of the present invention taken in conjunction with the accompanying drawings.

DETAILED DESCRIPTION OF THE INVENTION

Figure 1:
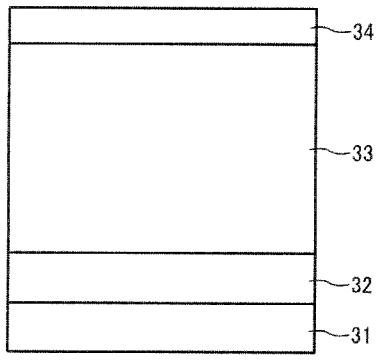
FIG. 1 is a cross-sectional view of an embodiment of the photosensitive layer of the electrophotographic photoreceptor of the present invention.

The present invention provides an electrophotographic photoreceptor having both high mechanical durability and high releasability, and stably producing high-quality images for long periods even after repeatedly used for long periods.

More particularly, the present invention relates to an electrophotographic photoreceptor, comprising:

an electroconductive substrate;

a photosensitive layer, overlying the substrate; and a cured protection layer, overlying the photosensitive layer, wherein the cured protection layer comprises a cured material of a tri- or more functional radical polymerizable compound and a filler exposed from the surface of the cured protection layer which comprises a bump along the surface of the filler, and wherein the cured protection layer has a thickness (T) larger than a diameter (2r) of the filler therein and the following relationships (a) is satisfied:

$$(\text{the number of the fillers present to a depth of } T/2 \text{ from a free surface of the cured protection layer/ the total number of the fillers in the cured protection layer})\times 100 \geq 7\% \quad \text{(a).}$$

The electrophotographic photoreceptor including an electroconductive substrate, a photosensitive layer and a cured protection layer in this order of the present invention has the following features.

(A) The cured protection layer includes a hardened material of a tri- or more functional radical polymerizable compound to improve mechanical durability thereof, (B) the cured protection layer includes a filler which is not covered thereby to improve releasability thereof, (C) the cured protection layer contacting the filler has a bump along the filler to maintain releasability, and (D) the filler in the layer has a distribution closer to the outermost surface to improve releasability and produce high-quality images, and therefore the electrophotographic photoreceptor can be used for long periods.

These features of the present invention are explained in detail.

The cured protection layer includes a hardened material of a tri- or more functional radical polymerizable compound and a filler.

The cured protection layer may include an incurable charge transport material or a curable charge transport material.

The curing is typically a reaction forming a three-dimensional network structure by intermolecularly bonding low-molecular-weight compounds having plural functional groups or applying an energy such as neat, light and to polymeric compounds to be intermolecularly bonded, e.g., covalently bonded, to form a three-dimensional network structure.

The tri- or more functional radical polymerizable compound for use in the present invention includes monomers having no electron transport structure and three or more radical polymerizable functional groups, e.g., hole transport structures such as triarylamine, hydrazone, pyrazoline, and carbazole; and electron withdrawing aromatic rings having condensed polycyclic quinone, diphenoquinone, a cyano group or a nitro group.

As the radical polymerizable groups, any radical polymerizable groups having a carbon-carbon double bond can be used. Suitable radical polymerizable groups include the following 1-substituted ethylene groups and 1,1-substituted ethylene groups.

Specific examples of the 1-substituted ethylene groups include functional groups having the following formula (1):

$$CH_2{=}CH{-}X_1{-} \quad (1)$$

wherein $X_1$ represents an arylene group (such as a phenylene group and a naphthylene group), which optionally has a substituent, a substituted or unsubstituted alkenylene group, a —CO— group, a —COO— group, a)—CON($R^{10}$ group (wherein $R^{10}$ represents a hydrogen atom, an alkyl group (e.g., a methyl group, and an ethyl group), an aralkyl group (e.g., a benzyl group, a naphthylmethyl group and a phenetyl group) or an aryl group (e.g., a phenyl group and a naphthyl group)), or a —S— group.

Specific examples of the substituents include a vinyl group, a styryl group, 2-methyl-1,3-butadienyl group, a vinylcarbonyl group, acryloyloxy group, acryloylamide, vinyl thioether, etc.

Specific examples of the 1,1-substituted ethylene groups include functional groups having the following formula (2):

$$CH_2{=}C(Y){-}X_2{-} \quad (2)$$

wherein Y represents a substituted or unsubstituted alkyl group, a substituted or unsubstituted aralkyl group, a substituted or unsubstituted aryl group (such as phenyl and naphthyl groups), a halogen atom, a cyano group, a nitro group, an alkoxyl group (such as methoxy and ethoxy groups), or a —$COOR_{31}$ group (wherein $R_{31}$ represents a hydrogen atom, a substituted or unsubstituted alkyl group (such as methyl and ethyl groups), a substituted or unsubstituted aralkyl group (such as benzyl and phenethyl groups), a substituted or unsubstituted aryl group (such as phenyl and naphthyl groups) or a —$CONR_{32}R_{33}$ group (wherein each of $R_{32}$ and $R_{33}$ represents a hydrogen atom, a substituted or unsubstituted alkyl group (such as methyl and ethyl groups), a substituted or unsubstituted aralkyl group (such as benzyl, naphthylmethyl and phenethyl groups), a substituted or unsubstituted aryl group (such as phenyl and naphthyl groups); and $X_2$ represents a group selected from the groups mentioned above for use in $X_1$ and an alkylene group, wherein at least one of Y, and $X_2$ is an oxycarbonyl group, a cyano group, an alkenylene group or an aromatic group.

Specific examples of the substituents include an α-chloroacryloyloxy group, a methacryloyloxy group, an α-cyanoethylene group, an α-cyanoacryloyloxy group, an α-cyanophenylene group, a methacryloylamino group, etc.

Specific examples of the substituents for use in the groups $X_1$, $X_2$ and Y include halogen atoms, a nitro group, a cyano group, alkyl groups (such as methyl and ethyl groups), alkoxy groups (such as methoxy and ethoxy groups), aryloxy groups (such as a phenoxy group), aryl groups (such as phenyl and naphthyl groups), aralkyl groups (such as benzyl and phenethyl groups), etc.

The acryloyloxy groups and methacryloyloxy groups are preferably used as the radical polymerizable functional groups. The more the number of functional groups of radical polymerizable compounds or oligomers having no charge transport structure, the more preferable for mechanical durability and filler maintainability. When the tri- or more functional radical polymerizable compound is hardened, a three-dimensional network structure is developed and a layer having very high crosslink density, high hardness and high elasticity is formed, and which has uniformity, high smoothness, high abrasion resistance and scratch resistance as well. However, depending curing conditions and materials, many bonds are formed instantly and a volume contraction causes an inner stress, resulting in crack and peeling of film. In that case, a monofunctional or a bifunctional radical polymerizable compound, or a mixture thereof improves such problems.

A compound having an acryloyloxy group can be prepared by subjecting a compound including a hydroxyl group in its molecule and an acrylic acid (salt), an acrylic acid halide or an acrylic acid ester to an ester reaction or an ester exchange reaction. A compound having a methacryloyloxy group can similarly be prepared as well. Radical polymerizable functional groups in a monomer having plural radical polymerizable functional groups may be the same or different from each other.

As the tri- or more radical polymerizable compound, the ratio of a molecular weight relative to the functional group number in the monomer (molecular weight/functional group number) is desirably 250 or less, in order to form a dense crosslinking bond in a crosslinked surface layer. In addition, when this ratio is greater than 250, since the crosslinked surface layer is soft, and abrasion resistance is reduced to some extent, it is not preferable to use a monomer having an extreme long modified group alone, in a monomer having a modified group such as EO (adducts of ethyleneoxide group), PO (adducts of propyleneoxide group) or caprolactone.

Specific examples of the tri- or more radical polymerizable compounds include trimethylolpropane triacrylate (TMPTA), trimethylolpropane trimethacrylate, trimethylolpropanealkylene-modified triacrylate, trimethylolpropane-ethyleneoxy-modified (hereafter EO-modified) triacrylate, trimethylolpropanepropyleneoxy-modified (hereafter PO-modified) triacrylate, trimethylolpropanecaprolactone-modified triacrylate, trimethylolpropanealkylene-modified trimethacrylate, pentaerythritol triacrylate, pentaerythritol tetracrylate (PETTA), glycerol triacrylate, glycerol epichlorohydrin-modified (hereafter ECH-modified) triacrylate, glycerol EO-modified triacrylate, glycerol PO-modified triacrylate, tris(acryloxyethyl)isocyanurate, dipentaerythritol hexaacrylate (DPHA), dipentaerythritolcaprolactone-modified hexaacrylate, dipentaerythritolhydroxy pentaacrylate, alkylated dipentaerythritol pentacrylate, alkylated dipentaerythritol tetraacrylate, alkylated dipentaerythritol triacrylate, dimethylolpropane tetraacrylate (DTMPTA), pentaerythritolethoxy tetraacrylate, phosphoric acid EO-modified triacrylate, and 2,2,5,5-tetrahydroxymethylcyclopentanone tetracrylate. These can be used alone or in combination.

The cured protection layer of the present invention can be more cured with a hardener, a catalyst, a polymerization initiator previously mixed in a coating liquid forming the layer. This decreases unreacted functional groups, which improves abrasion resistance and prevents electrostatic properties from being deteriorated. Further, the reaction is uniformly performed, which decreases crack and distortion.

The radical polymerizable compound having a charge transport structure for use in the present invention is a compound which has a positive hole transport structure such as triarylamine, hydrazone, pyrazoline and carbazole or an electron transport structure such as condensed polycyclic quinone, diphenoquinone, a cyano group and an electron withdrawing aromatic ring having a nitro group, and has a radical polymerizable functional group. As the radical polymerizable groups, any radical polymerizable groups having a carbon-carbon double bond can be used.

The radical polymerizable compound having a charge transport structure for use in the present invention may have any functional groups. In the present invention, monofunctional radical polymerizable compounds are preferably used in terms of mechanical durability. This is because an extra stress is not applied to the layer when cured. Further, the monofunctional radical polymerizable compounds have better charge transportability than multifunctional ones. This is because the monofunctional ones have smaller molecular distortion.

The charge transport structure may be any materials capable of imparting a charge transport structure, and a triarylamine structure is effectively used. This is because the triarylamine structure has many hopping sites and an expanded conjugation. The triarylamines are likely to conjugate each other when being radical cationic. This is why the triarylamine structure has good charge transportability. Particularly a compound having the following formula (3) or (4) can preferably maintain electrical properties such as a sensitivity and a residual potential.

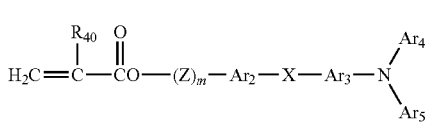

(3)

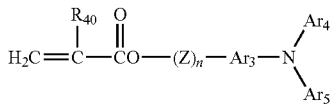

(4)

wherein $R_{40}$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_{41}$ wherein $R_{41}$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_{42}R_{43}$ wherein $R_{42}$ and $R_{43}$ independently represent a hydrogen atom, a halogen atom, a substituted or an unsubstituted alkyl group, a substituted or an unsubstituted aralkyl group and a substituted or an unsubstituted aryl group; $Ar_2$ and $Ar_a$ independently represent a substituted or an unsubstituted arylene group; $Ar_4$ and $Ar_5$ independently represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom and vinylene group; Z represents a substituted or an unsubstituted alkylene group, a substituted or an unsubstituted alkyleneether group and alkyleneoxycarbonyl group; and m and n represent 0 and an integer of from 1 to 3.

In the formulae (3) and (4), among substituted groups of $R_{40}$, the alkyl groups include methyl groups, ethyl groups, propyl groups, butyl groups, etc.; the aryl groups include phenyl groups, naphtyl groups, etc.; aralkyl groups include benzyl groups, phenethyl groups, naphthylmethyl groups, etc.; and alkoxy groups include methoxy groups, ethoxy groups, propoxy groups, etc. These may be substituted by alkyl groups such as halogen atoms, nitro groups, cyano groups, methyl groups and ethyl groups; alkoxy groups such as methoxy groups and ethoxy groups; aryloxy groups such as phenoxy groups; aryl groups such as phenyl groups and naphthyl groups; aralkyl groups such as benzyl groups and phenethyl groups. The substituted group of $R_{40}$ is preferably a hydrogen atom and a methyl group.

$Ar_4$ and $Ar_5$ independently represent a substituted or an unsubstituted aryl group, and specific examples thereof include condensed polycyclic hydrocarbon groups, non-condensed cyclic hydrocarbon groups and heterocyclic groups.

The condensed polycyclic hydrocarbon group is preferably a group having 18 or less carbon atoms forming a ring such as a fentanyl group, a indenyl group, a naphthyl group, an azulenyl group, a heptalenyl group, a biphenylenyl group, an As-indacenyl group, a fluorenyl group, an acenaphthylenyl group, a praadenyl group, an acenaphthenyl group, a phenalenyl group, a phenantolyl group, an anthryl group, a fluoranthenyl group, an acephenantolylenyl group, an aceanthrylenyl group, a triphenylel group, a pyrenyl group, a crycenyl group and a naphthacenyl group. Specific examples of the non-condensed cyclic hydrocarbon groups and heterocyclic groups include monovalent groups of monocyclic hydrocarbon compounds such as benzene, diphenylether, polyethylenediphenylether, diphenylthioether, and diphenylsulfone; monovalent groups of non-condensed hydrocarbon compounds such as biphenyl, polyphenyl, diphenylalkane, diphenylalkene, diphenylalkine, triphenylmethane, distyrylbenzene, 1,1-diphenylcycloalkane, polyphenylalkane and polyphenylalkene; and monovalent groups of ring gathering hydrocarbon compounds such as 9,9-diphenylfluorene. Specific examples of the heterocyclic groups include monovalent groups such as carbazole, dibenzofuran, dibenzothiophene, oxadiazole and thiadiazole.

Specific examples of the substituted or unsubstituted aryl group represented by $Ar_4$ and $Ar_5$ include the following groups:

(1) a halogen atom, a cyano group and a nitro group;

(2) a straight or a branched-chain alkyl group having 1 to 12, preferably from 1 to 8, and more preferably from 1 to 4 carbon atoms, and these alkyl groups may further include a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkyl groups include methyl groups, ethyl groups, n-butyl groups, i-propyl groups, t-butyl groups, s-butyl groups, n-propyl groups, trifluoromethyl groups, 2-hydroxyethyl groups, 2-ethoxyethyl groups, 2-cyanoethyl groups, 2-methocyethyl groups, benzyl groups, 4-chlorobenzyl groups, 4-methylbenzyl groups, 4-phenylbenzyl groups, etc.

(3) alkoxy groups (—$OR_{82}$) wherein $R_{82}$ represents an alkyl group specified in (2). Specific examples thereof include methoxy groups, ethoxy groups, n-propoxy groups, 1-propoxy groups, t-butoxy groups, s-butoxy groups, 1-butoxy groups, 2-hydroxyethoxy groups, benzyloxy groups, trifluoromethoxy groups, etc.

(4) aryloxy groups, and specific examples of the aryl groups include phenyl groups and naphthyl groups. These aryl group may include an alkoxy group having 1 to 4 carbon atoms, an alkyl group having 1 to 4 carbon atoms or a halogen atom as a substituent. Specific examples of the aryloxy groups include phenoxy groups, 1-naphthyloxy groups, 2-naphthyloxy groups, 4-methoxyphenoxy groups, 4-methylphenoxy groups, etc.

(5) alkyl mercapto groups or aryl mercapto groups such as methylthio groups, ethylthio groups, phenylthio groups and p-methylphenylthio groups.

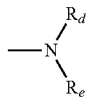

(6)

wherein $R_d$ and $R_e$ independently represent a hydrogen atom, an alkyl groups specified in (2) and an aryl group, and specific examples of the aryl groups include phenyl groups, biphenyl groups and naphthyl groups, and these may include an alkoxy group having 1 to 4 carbon atoms, an alkyl group having 1 to 4 carbon atoms or a halogen atom as a substituent, and $R_{10}$ and $R_{11}$ may form a ring together. Specific examples of the groups having this formula include amino groups, diethylamino groups, N-methyl-N-phenylamino groups, N,N-diphenylamino groups, N—N-di(tolyl)amino groups, dibenzylamino groups, piperidino groups, morpholino groups, pyrrolidino groups, etc.

(7) a methylenedioxy group, an alkylenedioxy group such as a methylenedithio group or an alkylenedithio group.

(8) a substituted or an unsubstituted styryl group, a substituted or an unsubstituted β-phenylstyryl group, a diphenylaminophenyl group, a ditolylaminophenyl group, etc.

The arylene group represented by $Ar_2$ and $Ar_3$ are derivative divalent groups from the aryl groups represented by $Ar_4$ and $Ar_5$.

The above-mentioned X represents a single bond, a substituted or an unsubstituted alkylene group, a substituted or an unsubstituted cycloalkylene group, a substituted or an unsubstituted alkyleneether group, an oxygen atom, a sulfur atom and vinylene group.

The substituted or unsubstituted alkylene group is a straight or a branched-chain alkylene group having 1 to 12, preferably from 1 to 8, and more preferably from 1 to 4 carbon atoms, and these alkylene groups may further includes a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkylene groups include methylene groups, ethylene groups, n-butylene groups, i-propylene groups, t-butylene groups, s-butylene groups, n-propylene groups, trifluoromethylene groups, 2-hydroxyethylene groups, 2-ethoxyethylene groups, 2-cyanoethylene groups, 2-methocyethylene groups, benzylidene groups, phenylethylene groups, 4-chlorophenylethylene groups, 4-methylphenylethylene groups, 4-biphenylethylene groups, etc.

The substituted or unsubstituted cycloalkylene group is a cyclic alkylene group having 5 to 7 carbon atoms, and these alkylene groups may include a fluorine atom, a hydroxyl group, a cyano group, an alkoxy group having 1 to 4 carbon atoms. Specific examples thereof include cyclohexylidine groups, cyclohexylene groups and 3,3-dimethylcyclohexylidine groups, etc.

Specific examples of the substituted or unsubstituted alkyleneether groups include ethylene oxy, propylene oxy, ethylene glycol, propylene glycol, diethylene glycol, tetraethylene glycol and tripropylene glycol. The alkylene group of the alkyleneether group may include a substituent such as a hydroxyl group, a methyl group and an ethyl group.

The vinylene group has the following formula:

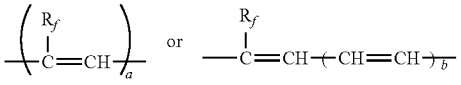

wherein $R_f$ represents a hydrogen atom, an alkyl group (same as those specified in (2)), an aryl group (same as those represented by $Ar_4$ and $Ar_5$); a represents 1 or 2; and b represents 1, 2 or 3.

Z represents a substituted or an unsubstituted alkylene group, a substituted or an unsubstituted divalent alkyleneether group and a divalent alkyleneoxycarbonyl group. Specific examples of the substituted or unsubstituted alkylene group include those of X. Specific examples of the substituted or unsubstituted divalent alkyleneether group include those of X. Specific examples of the divalent alkyleneoxycarbonyl group include caprolactone-modified groups.

In addition, the radical polymerizable compound having a charge transportable structure of the present invention is more preferably a compound having the following formula (5):

wherein o, p and q independently represent 0 or 1; $R_a$ represents a hydrogen atom or a methyl group; each of $R_b$ and $R_c$ represents a substituent besides a hydrogen atom and an alkyl group having 1 to 6 carbon atoms, and may be different from each other when having plural carbon atoms; s and t represent 0 or an integer of from 1 to 3; Za represents a single bond, a methylene group, ethylene group,

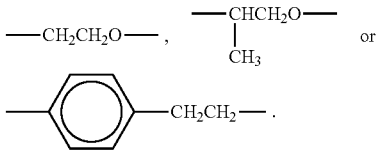

The compound having the formula (5) are preferably a compound having an methyl group or a ethyl group as a substituent of $R_b$ and $R_c$.

The monofunctional radical polymerizable compound having a charge transportable structure of the formulae (3), (4) and particularly (5) for use in the present invention does not become an end structure because a double bonding between the carbons is polymerized while opened to the both sides, and is built in a chain polymer. In a crosslinked polymer polymerized with a radical polymerizable monomer having three or more functional groups, the compound is present in a main chain and in a crosslinked chain between the main chains (the crosslinked chain includes an intermolecular crosslinked chain between a polymer and another polymer and an intramolecular crosslinked chain wherein a portion having a folded main chain and another portion originally from the monomer, which is polymerized with a position apart therefrom in the main chain are polymerized). Even when the compound is present in a main chain or a crosslinked chain, a triarylamine structure suspending from the chain has at least three aryl groups radially located from a nitrogen atom, is not directly bonded with the chain and suspends through a carbonyl group or the like, and is sterically and flexibly fixed although bulky. The triarylamine structures can spatially be located so as to be moderately adjacent to one another in a polymer, and has less structural distortion in a molecule. Therefore, it is assumed that the monofunctional radical polymerizable compound having a charge transportable structure in a surface layer of an electrophotographic photoreceptor can have an intramolecular structure wherein blocking of a charge transport route is comparatively prevented.

Specific examples of the radical polymerizable compound having a charge transporting structure for use in the present invention include, but are not limited to, compounds having the following formulae Nos. 1 to 39.

(5)

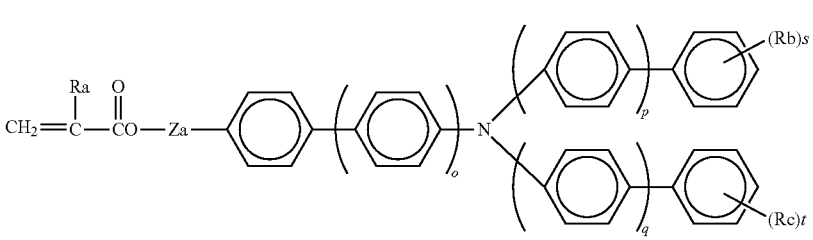

TABLE 1-1
No. 1
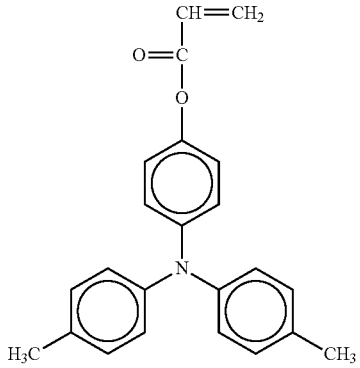
No. 2
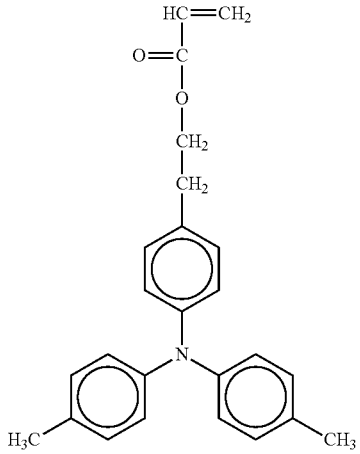
No. 3
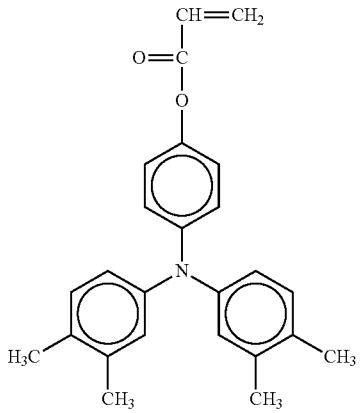
TABLE 1-1-continued
No. 4
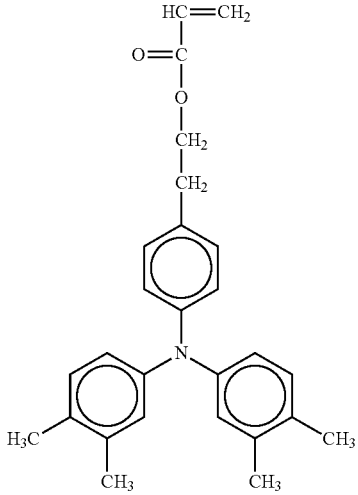
No. 5
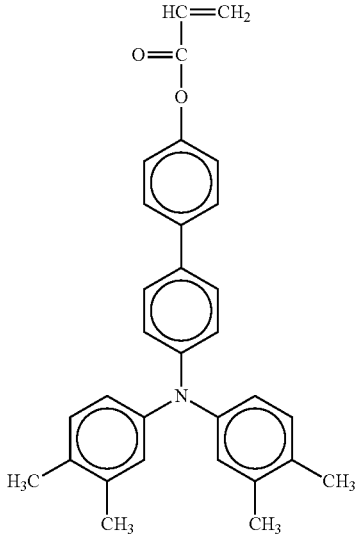
No. 6
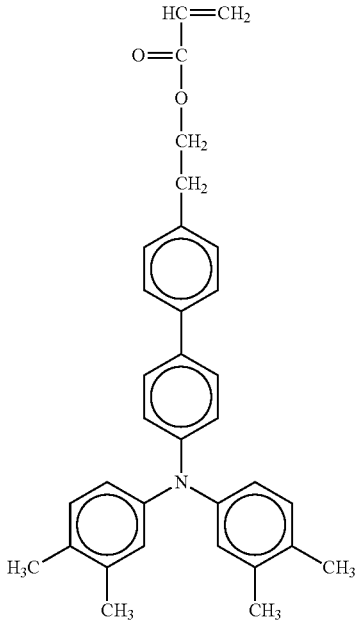

TABLE 1-1-continued
No. 7
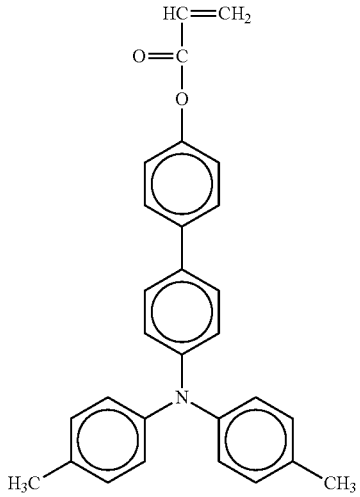
No. 8
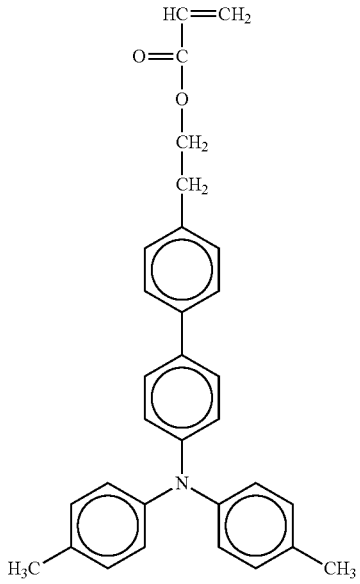
TABLE 1-1-continued
No. 9
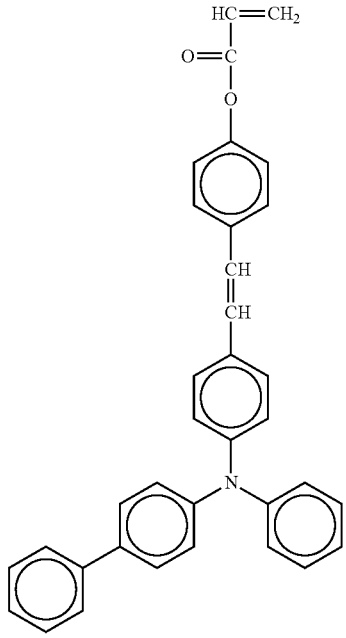
TABLE 1-2
No. 10
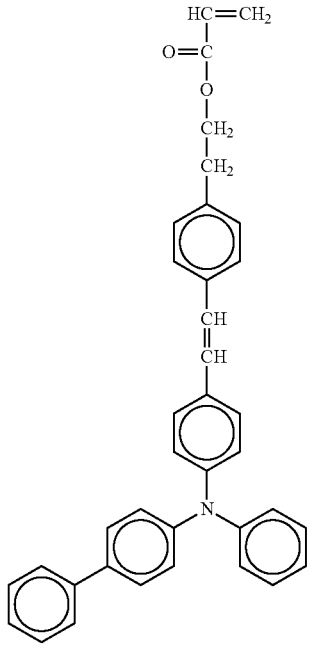

TABLE 1-2-continued
No. 11
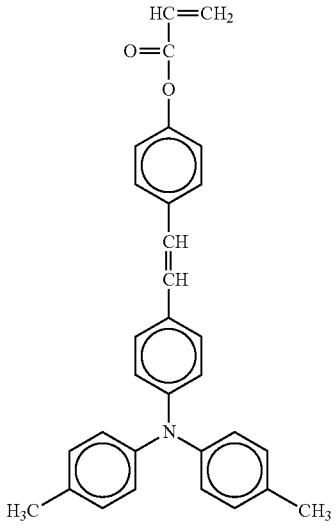
No. 12
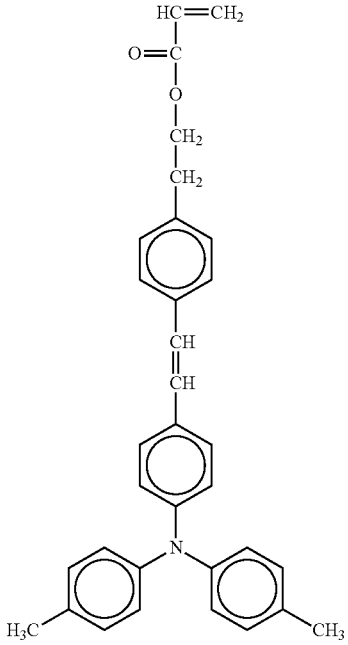
TABLE 1-2-continued
No. 13
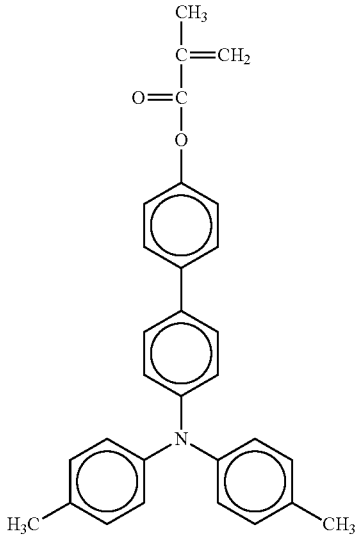
No. 14
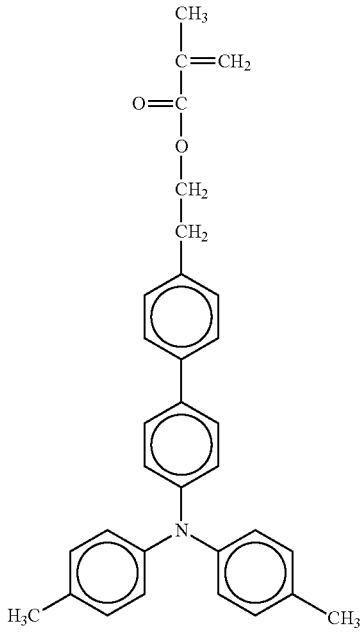

TABLE 1-2-continued
No. 15
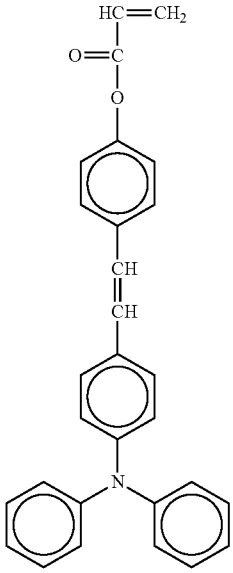
No. 16
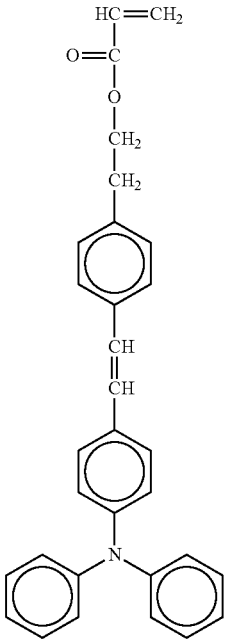
TABLE 1-2-continued
No. 17
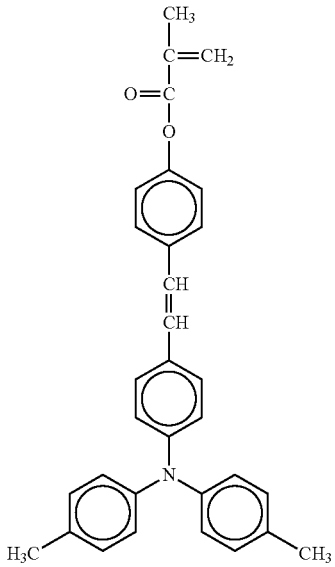
No. 18
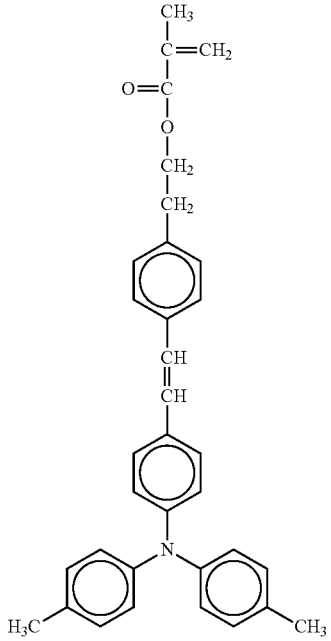

TABLE 1-3
No. 19
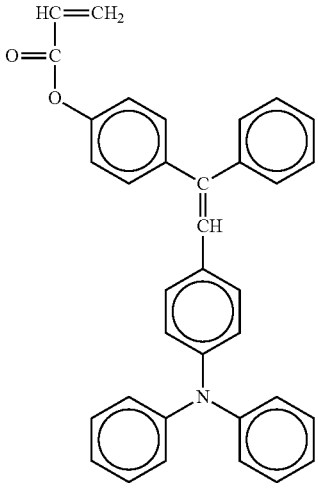
No. 20
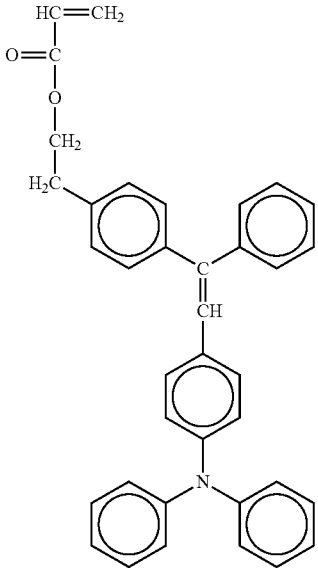
No. 21
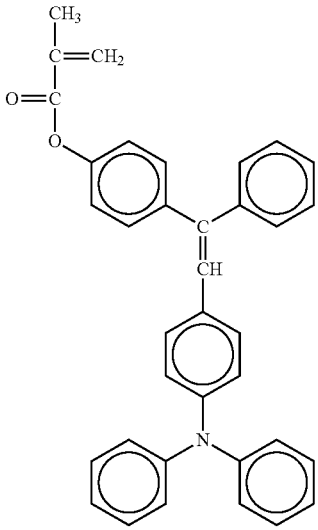
TABLE 1-3-continued
No. 22
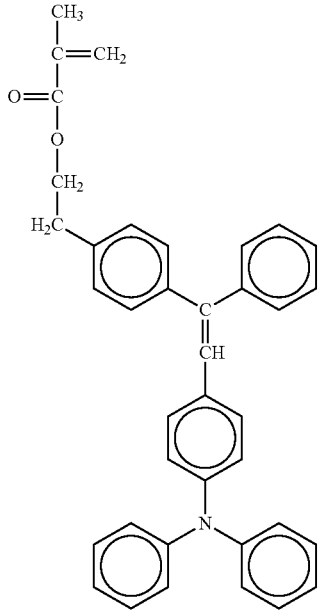
No. 23
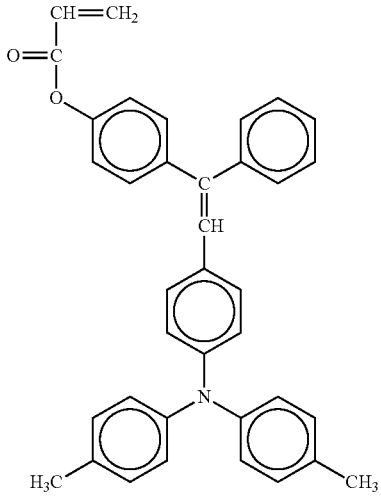

TABLE 1-3-continued
No. 24
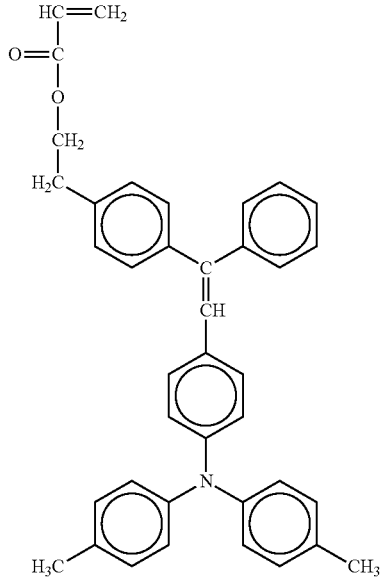
No. 25
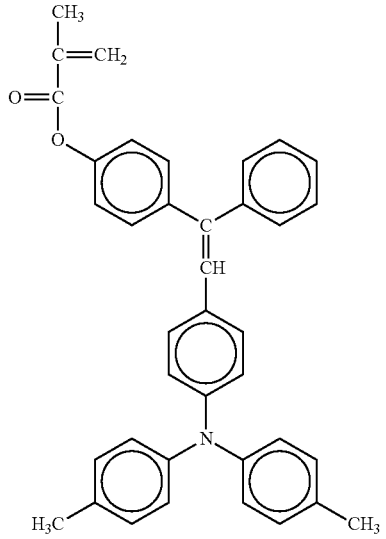
TABLE 1-3-continued
No. 26
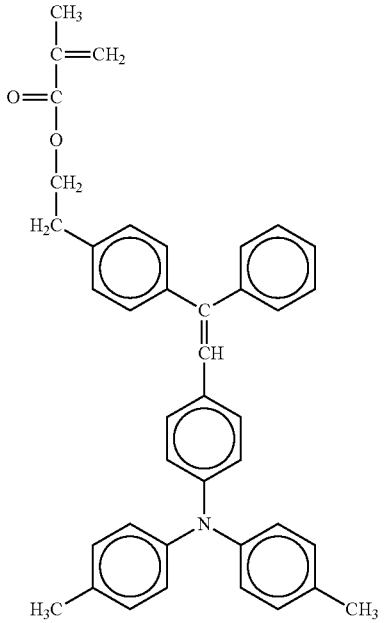
TABLE 1-4
No. 27
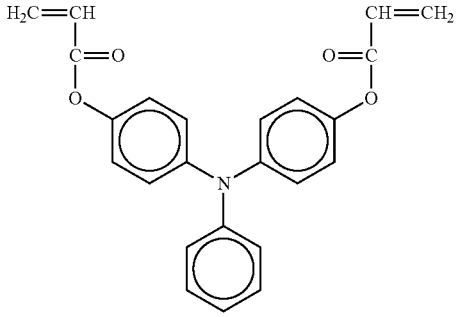
No. 28
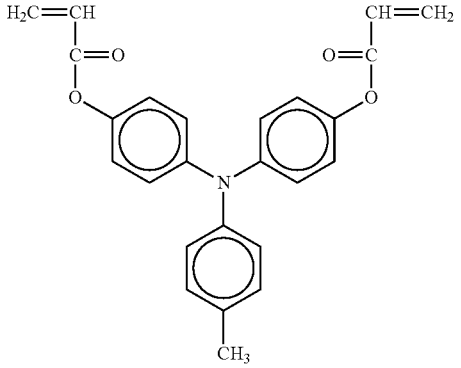

TABLE 1-4-continued
No. 29
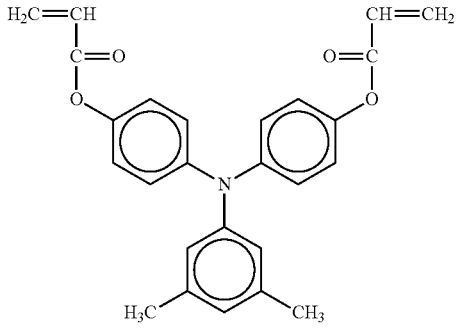
No. 30
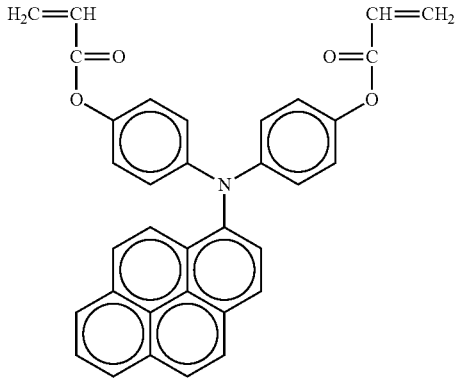
TABLE 1-4-continued
No. 31
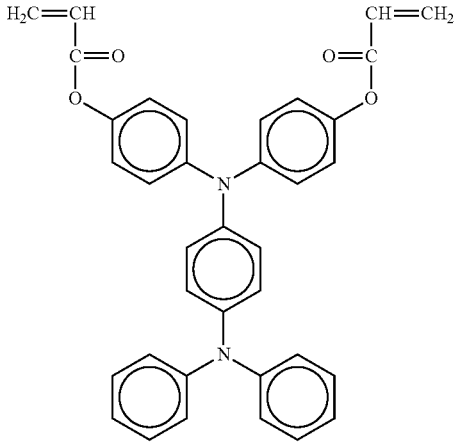
No. 32
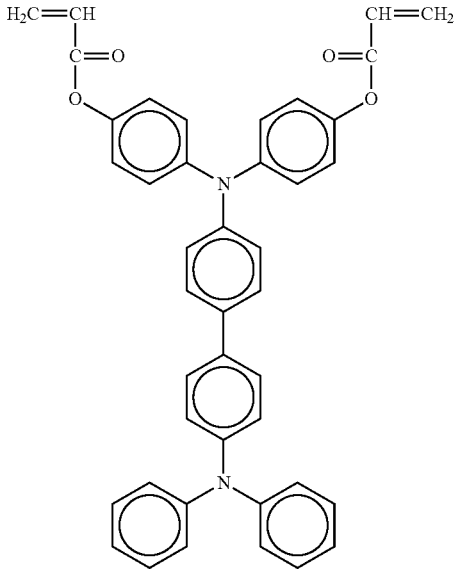
TABLE 1-5
No. 33
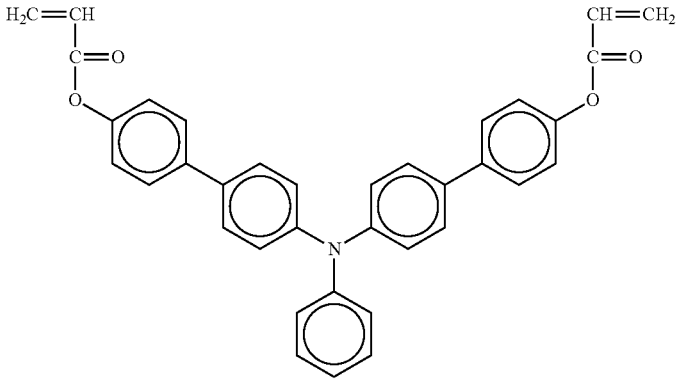

TABLE 1-5-continued
No. 34
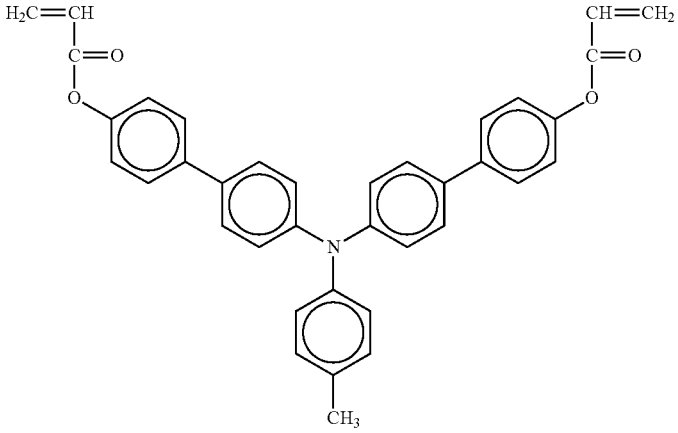
No. 35
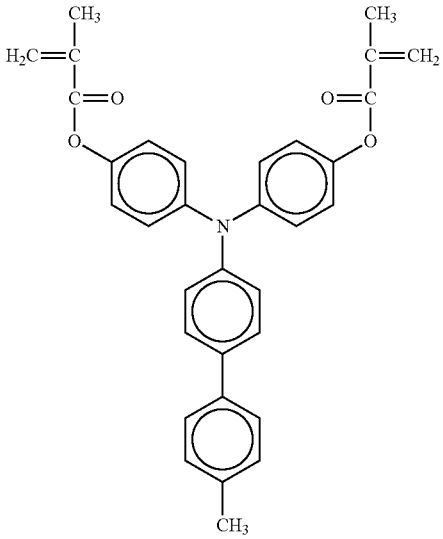
No. 36
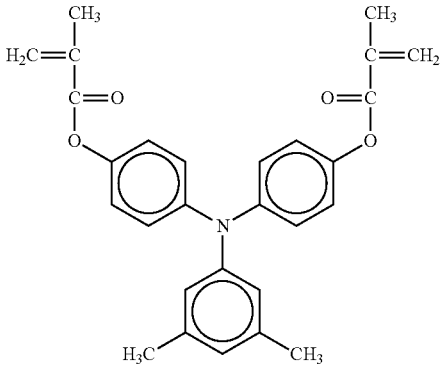

TABLE 1-6

No. 37

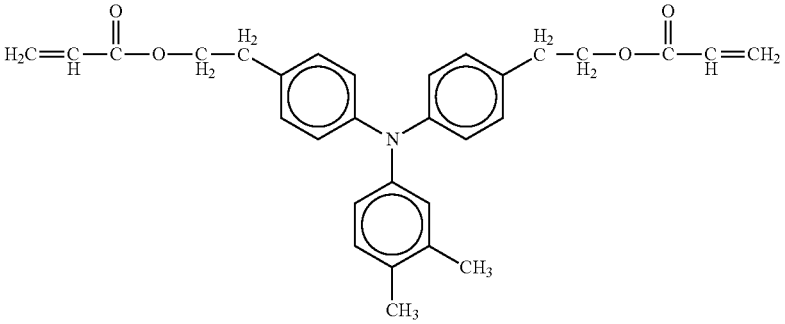

No. 38

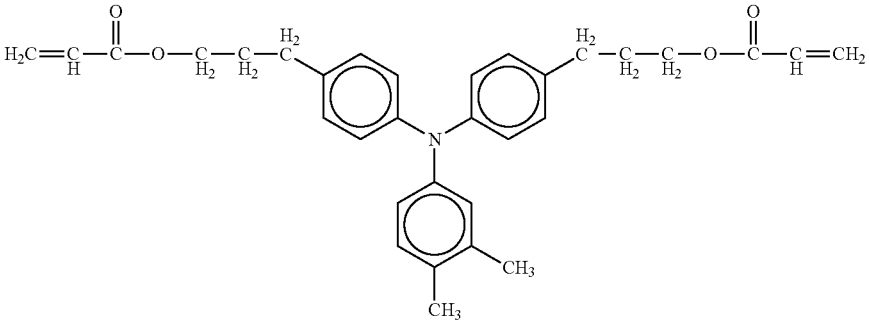

No. 39

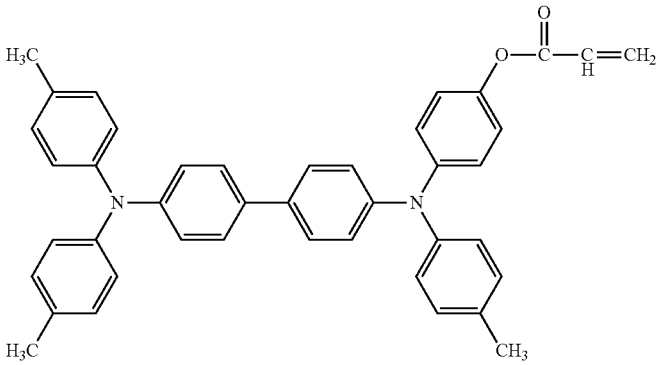

The radical polymerizable compound having a charge transporting structure for use in the present invention is preferably included in the cured protection layer in an amount of 20 to 80% by weight, and more preferably from 30 to 70% by weight based on total weight thereof except for the filler. When less than 20% by weight, the crosslinked surface layer cannot maintain the charge transportability, a sensitivity of the resultant photoreceptor deteriorates and a residual potential thereof increases in repeated use. When greater than 80% by weight, a content of the tri- or more functional monomer having no charge transportable structure decreases and the crosslinked density deteriorates, and therefore the resultant photoreceptor does not have a high abrasion resistance. Although it depends on a required abrasion resistance and electrical properties, in consideration of a balance therebetween, a content of the monofunctional radical polymerizable compound having a charge transportable structure is most preferably from 30 to 70% by weight.

When the radical polymerizable compound having a charge transporting structure is not used, an electroconductive filler, a charge controlling agent or an electroconductive polymer can be included in the cured protection layer to impart charge transportability thereto. Specific examples of the electroconductive filler include zinc antimonate, tin oxide, etc.

A content thereof is preferably from 5 to 30% by weight based o total weight of the cured protection layer except for the filler, and a particle diameter thereof is preferably from 10 nm to 300 nm.

The present invention relates to an electrophotographic photoreceptor including an electroconductive substrate, a photosensitive layer, and a cured protection layer in this order, a filler which is not covered by the cured protection layer is present therein, and the cured protection layer contacting the surface of the filler has a bump along the filler.

Figure 6:
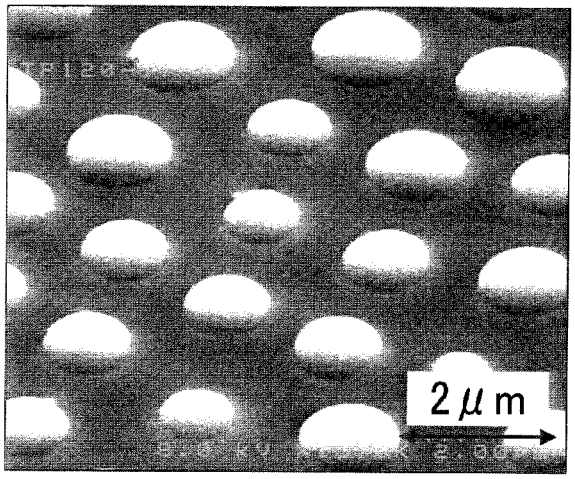
FIG. 6 is a 150,000-times magnified and 45° tilted SEM projection view of the electrophotographic photoreceptor of the present invention.

The filler which is not covered by the cured protection layer means a filler having an exposed part above as shown in FIG. 6. That the cured protection layer contacting the surface of the filler has a bump along the filler means a free surface of the cured protection layer has a bump along the filler covering the filler.

In the present invention, the filler which is not covered by the cured protection layer, i.e., the filler having an exposed part and the bump enable the layer to have high releasability and mechanical durability.

Figure 10:
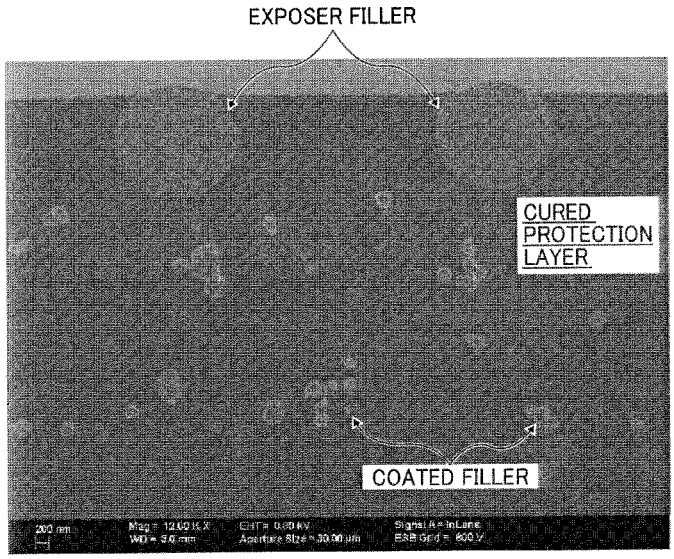
FIG. 10 is a picture of an exposed filler and a coated filler in the present invention.

It is thought the releasability improves because the exposed filler reduces an area contacting a toner and adherence thereof decreases, and adherence between the filler and the toner or toner additives is small. Further, the bump increases the filler retention. This prevents the filler from releasing, which is though to enable the layer to have high releasability and mechanical durability. This is basically different from a structure disclosed in Japanese published unexamined application No. 2006-267859, having no bump along a filler. Further, different from Japanese published unexamined application No. 2009-145480, the cured tri- or more functional radical polymerizable compound firmly fixes a filler. The cured protection layer of the present invention may include two or more fillers. The fillers having different particle diameters form moderate convexities and concavities and a contact of the cleaning blade is stabilized to improve cleanability. In addition, the fillers may include a first filler and a second filler formed of a material different from that of the first filler. Functionally-separated plural fillers can improve total functions. For example, a combination of a filler having releasability and a filler having high mechanical durability such as metal oxide can more improve releasability and mechanical durability of the layer. Further, the cured protection layer may include a filler coated thereby. The coated filler means a filler coated by the cured protection layer as a filler having a small particle diameter in FIG. 10. When the coated filler is present at the surface of the cured protection layer, the filler occasionally forms a bump, but the surface of the filler is coated by the cured protection layer. The coated filler can be formed by coating a cured protection layer coating liquid in which a filler is dispersed. The coated filler improves strength and mechanical durability of the cured protection layer, and retention of the exposed filler.

In the present invention, the two fillers are preferably an organic filler including a silicon or a fluorine atom and a metal oxide filler. This combination prevents foreign particles from adhering to the layer. The reason is not clarified, but it is thought frictional forces between each of the fillers and a cleaning blade are different from each other, and stick slip movement of the cleaning blade is accelerated more than when using a single filler and scrapability of foreign particles improves. Further, the combination improves releasability and mechanical durability of the layer, because each of the fillers is though to efficiently exert its effect.

In other words, (A) the cured protection layer of the present invention includes a cured material of tri- or more functional radical polymerizable compound, (B) fillers are present at the surface of the cured protection layer in the shape of sea-island, the fillers are partly exposed on the surface of the protection layer at an exposition rate less than 50% based on total surface area, and the exposed part is not covered by the cured protection layer, and (C) the exposed part has a bump along a ring-shaped hem thereof. The bump is formed by placing a filler on a coated layer and compressing a part thereof into the layer after the protection layer is formed.

In addition, the filler has a radius r and the cured protection layer has a thickness T satisfying the following relationship:

$$T>2r,$$

and the following relationships (a) is satisfied:

$$(\text{the number of the fillers present to a depth of } T/2 \text{ from a free surface of the cured protection layer/ the total number of the fillers in the cured protection layer})\times 100\geq 7\% \quad \text{(a).}$$

When the protection layer has a thickness larger than a diameter of the filler and the formula (a) is satisfied, the layer improves in releasability. Further, charge traps in the protection layer are decreased and increase of residual potential is prevented. When the filler is not spherical, half of a distance between the furthest two points observed in the filler is a radius.

The bump of the present invention preferably satisfies the following relationship (b):

$$0.015\times r/2\leq h1\leq 0.5\times h2 \quad \text{(b)}$$

wherein r is a particle diameter of the filler (a distance between the furthest two points in the filler), h1 is a maximum height of the bump covering the filler from the outermost surface, and h2 is a distance from the bottom of the bump to the highest point of the exposed part of the filler. These are specifically shown in FIGS. 8 and 9.

When h1 is less than 0.015×r/2, the filler deteriorates in retention and tends to release. When greater than 0.5×h2, the filler is exposed less and does not exert its releasability.

h1 is related to a crosslinked protection layer before hardened and a surface tension of the filler, and is adjusted by viscosity of the crosslinked protection layer before hardened and a spray pressure of the filler.

The cured protection layer of the present invention preferably satisfies the following relationship (c):

$$0.10\leq S1/(S1+S2)\leq 0.50 \quad \text{(c)}$$

wherein S1 is a projection area of the filler having a part which is not covered by the cured protection layer and S2 is a projection area of a part where the filler is not present.

When S1/(S1+S2) is less than 0.1, the releasability us not fully exerted.

When greater than 0.50, writing light does not fully transmits, resulting in deterioration of image quality. S1/(S1+S2) is adjusted by the number of spraying.

When the first filler is an organic filler including a silicon or a fluorine atom and the second filler is a metal oxide filler, the following relationship (d) is preferably satisfied:

$$0.3\leq Sa/(Sa+Sb)\leq 0.7 \quad \text{(d)}$$

wherein Sa is a projection area of the organic filler including a silicon or a fluorine atom and Sb is a projection area of at least one metal oxide filler when the cured protection layer is projected from above.

When Sa/(Sa+Sb) is less than 0.3 or greater than 0.7, more foreign particles adhere to the layer. When (d) is satisfied, foreign particles less adhere to the layer. Further, abrasion of cleaning blade is reduced as well. The reason is not clarified, but plural fillers having different friction forces with the cleaning blade are thought to change stick slip.

In the present invention, to expose the surface of a filler, and to form a bump along the filler on the cured protection layer contacting the surface of the filler, the filler is coated on the cured protection layer and hardened after the protection layer is formed. Coating methods include, but are not limited to, coating a filler dispersion with a spray gun, coating a filler itself with a spray gun and electrostatic spray methods.

A coating method of the present invention is different from conventional ones. Typically, when a cured protection layer including a filler is formed, a protection layer coating liquid in which a filler is dispersed is used. Since the dispersion liquid is cured after coated, the fillers are almost uniformly present in the layer and the exposed fillers are few. The exposed fillers increase when the layer has a thickness thinner relative to the filler diameter, but do not as the method of the present invention does. Japanese published unexamined application No. 2009-145480 discloses a method of including a process of transferring a filler in a filler dispersion to the surface of a layer to form a cured protection layer in which the fillers (lubricative particles) gather near the surface of the layer. This further needs a process of transferring the filler to the surface, and a bifunctional material forms the layer, which is thought to have a filler retention smaller than that of the present invention using a tri- or more functional material. Further, the process is likely to leave the protection layer components at the surface of the filler because the coated filler transfers thereto. Therefore, fewer fillers are exposed than those of the present invention. Japanese published unexamined application No. 2002-357914 discloses a method of coating plural dispersions each including a filler and having a different concentration thereof such that the resultant layer has a concentration gradient. In this method, each of the fillers may possibly exerts its different effect. However, in this method, most of the fillers are coated by the protection layer. Therefore, even when a filler having releasability included in the protection layer, it does not have sufficient releasability.

On the other hand, the present invention applies a cured protection layer coating liquid and applies a filler before curing the coating liquid. Then, the protection layer coating liquid is cured. More partly-exposed fillers are present on the surface of the layer than those on the layer formed by the method transferring the filler included in a coating liquid. In addition, since the filler is coated on the wet layer before cured, the end of the filler has a bump along the filler. Relatively many exposed fillers can efficiently impart their effects to the layer. For example, effects of silicone fillers and fluorine-containing fillers having high releasability can highly be exerted. A filler which cannot ordinarily be used can be used in the present invention. For example, TOSPEARL in Example largely increases bright space potential when coated in a dispersion, but can prevent increase of bright space potential when coated by the method of the present invention. Japanese published unexamined application No. 2006-267859 discloses a method of coating a protection layer and providing a filler separately. However, this is different from the present invention in driving a filler in a protection layer after hardened. The filler is exposed on the surface of the cured protection layer as it is in the present invention, but there is no bump around the exposed filler because of being driven in after the protection layer is cured. Therefore, the filler retention is low and the releasability is not maintained for long periods. Japanese published unexamined application No. 2001-232954 discloses a method of including a filler having a particle diameter larger than a thickness of a protection layer in a coating liquid to form a projected filler. A layer formed by such a coating liquid is likely to be unevenly formed. Further, the particle diameter of the filler is limited depending on the thickness of the protection layer. Since the filler projects from a coating liquid, resin components coat a large area of the filler and the filler does not fully exert its effect. In addition, it is difficult to control projection of the filler. In contrast, the coating method of the present invention can enlarge the exposed area of the filler, and can easily control presence of the filler such as an area ratio and an exposure of the filler. Further, exposure of fillers which are difficult to keep dispersion in a coating liquid or having particle diameters largely different from each other can easily be controlled.

However, the surface of the electrophotographic photoreceptor of the present invention may be formed by other methods.

The following particulate fillers can be used. Organic filler materials include fluorine resin powders such as polytetrafluoroethylene, silicone resin powders and particulate carbons. The particulate carbons are particulate materials including carbon atoms as main components, having amorphous, diamond, graphite, amorphous carbon, fullerene, zeppelin, carbon nanotube, carbon nanohorn structures, etc. Among these structures, particulate materials having hydrogen-containing diamond-like carbon structures or amorphous carbon structures have good mechanical and chemical durability. The hydrogen-containing diamond-like carbon structures or the amorphous carbon structures are particulate materials in which similar structures such as diamond structures having SP3 orbits, graphite structures having SP2 orbits and amorphous carbon structures are mixed. The diamond-like carbon or the amorphous carbon particulate materials are formed of not only carbons, but also may include other atoms such as hydrogen, oxygen, nitrogen, fluorine, boron, phosphorus, chlorine, bromine iodine, etc. The organic filler materials include, but are not limited to, polymethacrylate, polystyrene, melamine, etc. Organic-inorganic fillers such as silica acrylic complex materials can be used.

Specific examples of the inorganic filler materials include metallic powders such as copper, tin, aluminium and indium; metal oxides such as silicon oxide, aluminum oxide, tin oxide, zinc oxide, titanium oxide, indium oxide, antimony oxide and bismuth oxide; and inorganic materials such as kalium titanate. Among these fillers, inorganic materials are advantageously used in terms of hardness of the filler. Particularly, metal oxides such as silicon oxide, aluminum oxide and titanium oxide are preferably used. Particulate colloidal silica and colloidal alumina can be used as well.

Fillers including a silicon atom and a fluorine atom such as silica, silicone, PTFE and PFA are preferably used in terms of releasability. Metal oxide fillers, particularly an alumina filler is preferably used in terms of abrasion resistance. A combination of first fillers including a silicon atom and a fluorine atom; and a second metal oxide fillers particularly an alumina filler is more preferably used. The first fillers impart releasability and the second fillers impart mechanical durability. Consequently, the resultant electrophotographic photoreceptor has significantly a longer life. When plural fillers are combined, the fillers preferably have different particle diameters each other.

The filler preferably has an average primary particle diameter of from 0.01 to 5 μm, and more preferably from 0.1 to 3 μm in terms of releasability and abrasion resistance.

Next, the electrophotographic method and image forming apparatus of the present invention of the present invention will be explained in detail.

Figure 2:
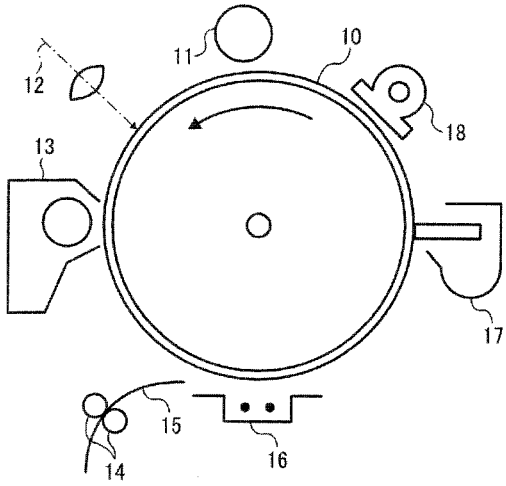
FIG. 2 is a schematic view illustrating an embodiment of the image forming apparatus of the present invention.

FIG. 2 is a schematic view for explaining an embodiment of the electrophotographic process and image forming apparatus of the present invention, the following example belongs to the scope of the present invention.

A photoreceptor 10 rotates in the direction of an arrow in FIG. 2, and a charger 11, an imagewise light irradiator 12, an image developer 13, a transferer 16, a cleaner 17, a discharger 18, etc. are located around the photoreceptor 10. The cleaner 17 and the discharger 18 can be omitted.

Image forming operation is basically made as follows. The surface of the photoreceptor 10 is uniformly charged by the charger 11. The imagewise light irradiator 12 irradiates the surface of the photoreceptor 10 with imagewise light to form an electrostatic latent image. The electrostatic latent image is developed by the image developer 13 to form a toner image on the surface of the photoreceptor. The toner image is transferred by the transferer 16 onto a transfer paper 15 fed to a transfer site by a feeding roller 14. The toner image is fixed on the transfer paper by a fixer (not shown). A toner untransferred onto the transfer paper is removed by the cleaner 17. A charge remaining on the photoreceptor is discharged by the discharger 18, and the next cycle follows.

In FIG. 2, the photoreceptor 10 has the shape of a drum, and may have the shape of a sheet or an endless belt. Known chargers such as corotrons, scorotrons, solid state chargers, charging rollers and charging brushes can be used for the charger 11 and the transferer 16.

Suitable light sources for the imagewise light irradiator 12 and the discharger 18 include general light-emitting materials such as fluorescent lamps, tungsten lamps, halogen lamps, mercury lamps, sodium lamps, LEDs, LDs, light sources using electroluminescence (EL), etc. Among these, LEDs and LDs are mostly used.

In addition, in order to obtain light having a desired wave length range, filters such as sharp-cut filters, band pass filters, near-infrared cutting filters, dichroic filters, interference filters, color temperature converting filters can be used.

Figure 5:
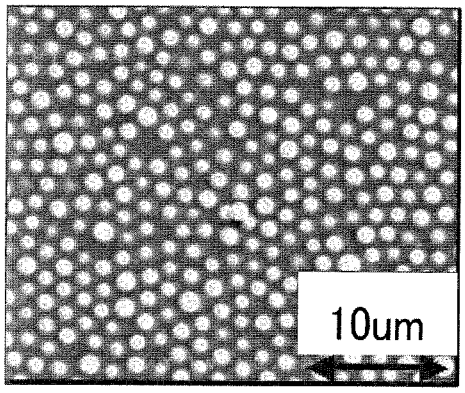
FIG. 5 is a 3,000-times magnified SEM projection view of the electrophotographic photoreceptor of the present invention.

The above-mentioned light sources can be used for not only the process illustrated in FIG. 5, but also other processes such as a transfer process, a discharging process, a cleaning process, a pre-exposure process include light irradiation to the photoreceptor 10. However, in the discharging process, the photoreceptor 10 is largely influenced by the irradiation, resulting in occasional deterioration of chargeability and increase of residual potential.

Therefore, a reverse bias is optionally applied in the charging process and cleaning process instead of irradiation to discharge, which improves durability of the photoreceptor.

When the photoreceptor positively (or negatively) charged is exposed to imagewise light, an electrostatic latent image having a positive (or negative) charge is formed on the photoreceptor. When the latent image having a positive (or negative) charge is developed with a toner having a negative (or positive) charge, a positive image can be obtained. In contrast, when the latent image having a positive (negative) charge is developed with a toner having a positive (negative) charge, a negative image can be obtained.

As the developing method, known developing methods can be used. Further, known discharging methods can be used as the discharging method.

When the image forming process is repeated, contaminants adhere to the surface of a photoreceptor. Among the contaminants adhering to the surface thereof, a discharge material generated by charging and an external additive in a toner are vulnerable to humidity and cause abnormal images. A paper powder is also one of materials causing abnormal images, and it adheres to a photoreceptor, incidentally resulting in not only production of abnormal images but also deterioration of abrasion resistance and sectional abrasion of the photoreceptor. Adherence of the contaminants (foreign particles) is particularly a serious problem for direct transfer methods effective for the apparatus to become compact and inexpensive. Therefore, photoreceptors free from the adherence, having mechanical durability are needed.

When a toner image formed on the photoreceptor 10 by the image developer 13 is transferred onto the transfer paper 15, all of the toner image is not transferred thereto, and a residual toner remains on the surface of the photoreceptor 10. The residual toner is removed from the photoreceptor by a fur brush or a cleaning blade.

The residual toner remaining on the photoreceptor can be removed by only the brush or a combination with the blade. When a toner has poor transferability, the toner on the photoreceptor untransferred increases, resulting in deterioration of durability of the cleaner. Therefore, a toner needs to improve in transferability as well. Higher transferability can decrease waste toner and effectively use toner.

The above-mentioned image forming units may be fixedly set in a copier, a facsimile or a printer. However, the image forming units may be set therein as a process cartridge.

Figure 3:
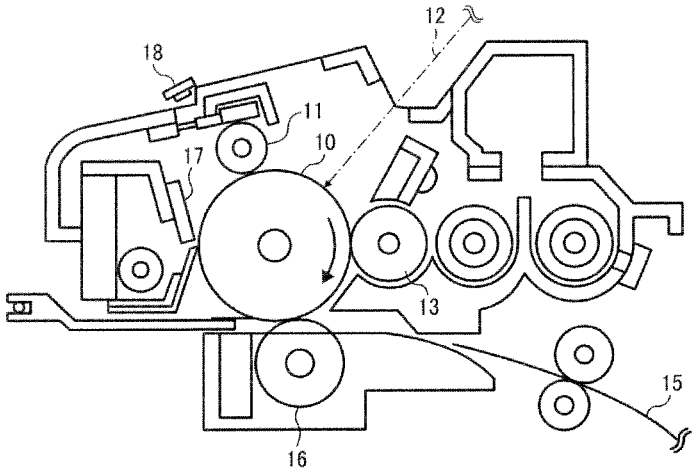
FIG. 3 is a schematic view illustrating an embodiment of the process cartridge of the present invention.

The process cartridge means an image forming unit (or device) including at least a photoreceptor 10, and one of a charger 11, an imagewise light irradiator 12, an image developer 13, an image transferer 16, a cleaner 17 and a discharger as shown in FIG. 3.

Next, an observation with a scanning electron microscope (SEM) will be explained. However, the method is not limited thereto so long as projection status of the filler can be observed.

An average diameter, a number and an area ratio of the filler can be determined by photographing a surface of an electrophotographic photoreceptor with an SEM; and analyzing an image thereof reflected on a SEM image with an image analyzer.

The SEM image is photographed from the right above, and the image of the filler is also an image seen from the right above.

The image is analyzed using an image analyzer and an image analysis software. Specific examples of the image analyzer include dedicated devices such as a highly-detailed image analyzing system IP-1000 from Asahi Engineering Co., Ltd., computers installed with an image analyzing software Image-Pro Plus from Planetron, Inc., and LMeye from Lasertec Corp. Image data including the filler and image data excluding the filler are digitalized to determine an area ratio of each.

Even an inner status around a surface is occasionally imaged as a SEM image when the SEM has a high acceleration voltage. Therefore, the acceleration voltage needs to be adjusted so as to reflect only the filler exposed on the surface.

For example, when a field emission SEM S-4200 from Hitachi, Ltd. is used as a SEM, the acceleration voltage is preferably from 2 to 6 kv, which needs to optionally be adjusted according to the analyzer and materials of a photoreceptor.

An SEM image of the surface is imported into the image analysis software, and an average diameter and an area ratio of the filler are determined to observe a status of the filler on the surface of a photoreceptor. Specifically, an SEM image photographed by a field emission SEM S-4200 from Hitachi, Ltd. at an acceleration voltage of 8 kv and 3,000 times is obtained. The SEM image data of a part on which the fillers are present and the other part on which the filler is not present digitalized using the image analyzing software LMeye from Lasertec Corp. An area ratio of the digitalized parts can be determined by the same software.

A thermal field emission scanning electron microscope (FE-SEM) can be used as well to observe further in detail. The FE-SEM has a brightness of some hundred times as high as that of the SEM and can observe at high image resolution.

In the present invention, the thermal FE-SEM is used to observe a cross-sectional status of the filler present in the cured protection layer. Specifically, the filler is observed by the following method, but the methods are not limited thereto.

First, platinum palladium is coated on a chip of an electrophotographic photoreceptor to impart electroconductivity thereto, and platinum carbon is coated thereon to protect the surface thereof. Thus, a sample is prepared. The cross-section of the sample is modified using a focused ion beam (FIB), and is observed with a thermal FE-SEM. As the FIB apparatus, Quanta 2000 3D from FEI Company Japan Ltd., and as the thermal FE-SEM, ULTRA55 from Carl Zeiss can be used.

Figure 8:
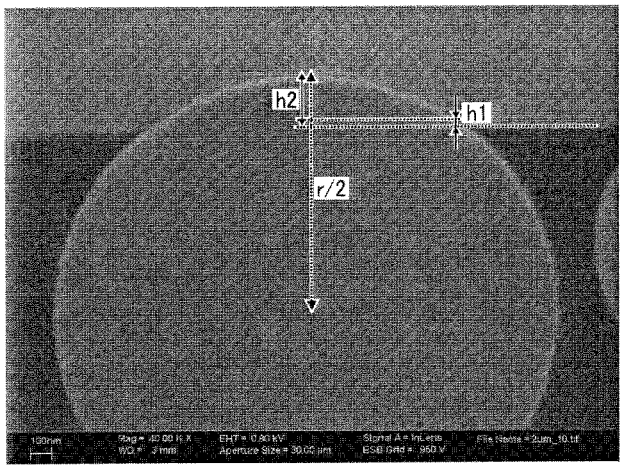
FIG. 8 is another picture of a bump along the surface of the filler projecting from the surface of the cured protection layer in the present invention, wherein h1 is a height of the bump, r/2 is a half of a particle diameter of the filler, and h2 is a distance from a bottom line of the bump to the highest point of the exposed filler.

From the cross-sectional image from the observation, the height of a bump of the filler in the cured protection layer is determined. Specifically, as FIG. 8 shows, a maximum height of a bump covering the filler from the outermost surface h1, and a distance from the bottom of the bump to a peak of the exposed part of the filler h2 are determined.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example 1

Synthesis of Titanylphthalocyanine Crystal

A pigment was prepared by the method disclosed in Example 1 of Japanese published unexamined application No. 2004-83859. Specifically, 292 parts of 1,3-diiminoisoindoline and 1,800 parts of sulfolane were mixed to prepare a mixture, and 204 parts of titanium tetrabutoxide was dropped into the mixture under a nitrogen gas flow. The mixture was then gradually heated to have a temperature of 180° C. and a reaction was performed for 5 hours at a temperature of from 170 to 180° C. while agitating. After the reaction, the reaction product was cooled, followed by filtering. The thus prepared wet cake was washed with chloroform until the cake colored blue. Then the cake was washed several times with methanol, followed by washing several times with hot water heated to 80° C. and drying to prepare a crude titanylphthalocyanine. One part of the thus prepared crude titanylphthalocyanine was dropped into 20 parts of concentrated sulfuric acid to be dissolved therein. The solution was dropped into 100 parts of ice water while stirred, to precipitate a titanylphthalocyanine pigment. The pigment was obtained by filtering. The pigment was washed with ion-exchange water having a pH of 7.0 and a specific conductivity of 1.0 μS/cm until the filtrate became neutral. In this case, the pH and specific conductivity of the filtrate was 6.8 and 2.6 μS/cm. Thus, an aqueous paste of a titanylphthalocyanine pigment was obtained.

Forty (40) parts of the thus prepared aqueous paste of the titanylphthalocyanine pigment were placed in 200 parts of tetrahydrofuran, and the mixture was strongly agitated with a HOMOMIXER (MARK IIf from Kenis Ltd.) at 2,000 rpm and at room temperature until the color of the paste was changed from navy blue to light blue. The color was changed after the agitation was performed for about 20 minutes. The dispersion was then filtered under a reduced pressure. The thus obtained crystal on the filter was washed with tetrahydrofuran to prepare a wet cake of the pigment. The wet cake was dried for 2 days at 70° C. under a reduced pressure of 5 mmHg to prepare 8.5 parts of a titanylphthalocyanine crystal. The wet cake included a solid content in an amount of 15% by weight. The weight ratio of the titanylphthalocyanine crystal to the crystal changing solvent (i.e., THF) was 1/33. The materials used therefor do not include a halogenated compound.

Figure 4:
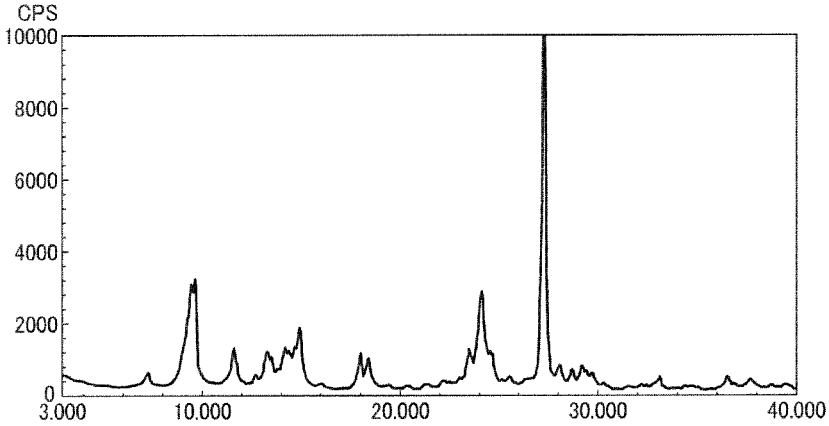
FIG. 4 is an X-ray diffraction spectrum of a charge generation material used in Examples, in which a vertical axis represents cps (counts per second) and a horizontal axis represents an angle (2θ)

X-ray diffraction spectrum of the titanylphthalocyanine powder was measured by the following conditions to find that a maximum peak is observed at a Bragg (2θ) angle of 27.2±0.2°, a lowest angle peak at an angle of 7.3±0.2°, and a main peak at each of angles of 9.4±0.2°, 9.6±0.2°, and 24.0±0.2°, wherein no peak is observed between the peaks of 7.3° and 9.4° and at an angle of 26.3°. The result is shown in FIG. 4.

<X-Ray Diffraction Spectrum Measurement Conditions>

X-ray tube: Cu

Voltage: 50 kV

Current: 30 mA

Scanning speed: 2°/min

Scanning range: 3 to 40°

Time constant: 2 sec

Synthesis Example 2

The monofunctional radical polymerizable compound having a charge transportable structure is explained in the present invention is synthesized by, e.g., a method disclosed in Japanese Patent No. 3164426. The following method is one of the examples thereof.

(1) Synthesis of a Hydroxy Group Substituted Triarylamine Compound Having the Following Formula B 113.85 parts (0.3 mol) of a methoxy group substituted triarylamine compound having the following formula A, 138 parts (0.92 mol) of sodium iodide and 240 parts of sulfolane were mixed to prepare a mixture. The mixture was heated to have a temperature of 60° C. in a nitrogen stream. 99 parts (0.91 mol) of trimethylchlorosilane were dropped therein for 1 hr and the mixture was stirred for 4 hrs at about 60° C.

About 1500 parts of toluene were added thereto and the mixture was cooled to have a room temperature, and repeatedly washed with water and an aqueous solution of sodium carbonate.

Then, a solvent removed therefrom and refined by a column chromatographic process using silica gel as an absorption medium, and toluene and ethyl acetate (20-to-1) as a developing solvent. Cyclohexane was added to the thus prepared buff yellow oil to separate a crystal out. Thus, 88.1 parts (yield of 80.4%) of a white crystal having the following formula B and a melting point of from 64.0 to 66.0° C. was prepared.

A

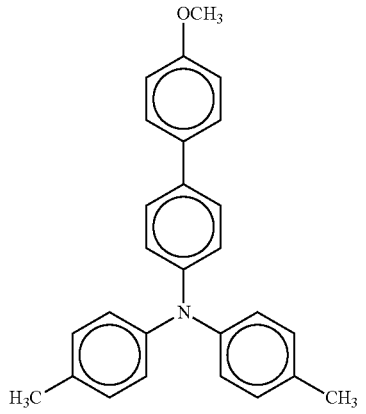

-continued

B

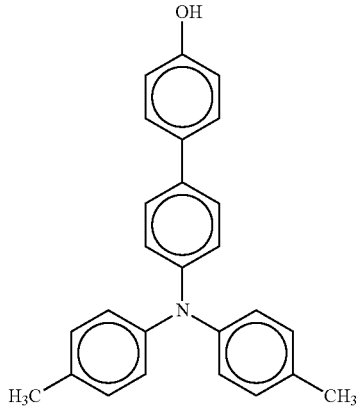

Elemental Analysis Value (%)

| | C | H | N |
|---|---|---|---|
| Found value | 85.06 | 6.41 | 3.73 |
| Calculated value | 85.44 | 6.34 | 3.83 |

(2) A Triarylamino Group Substituted Acrylate Compound (Compound No. 54)

82.9 pars (0.227 mol) of the hydroxy group substituted triarylamine compound having the formula B prepared in (1) were dissolved in 400 ml of tetrahydrofuran to prepare a mixture, and an aqueous solution of sodium hydrate formed of 12.4 parts of NaOH and 100 mil of water was dropped therein in a nitrogen stream. The mixture was cooled to have a temperature of 5° C., and 25.2 parts (0.272 mol) of chloride acrylate was dropped therein for 40 min. Then, the mixture was stirred at 5° C. for 3 hrs. The mixture was put in water and extracted with toluene. The extracted liquid was repeatedly washed with water and an aqueous solution of sodium carbonate. Then, a solvent removed therefrom and refined by a column chromatographic process using silica gel as an absorption medium and toluene as a developing solvent. N-hexane was added to the thus prepared colorless oil to separate a crystal out. Thus, 80.73 parts (yield of 84.8%) of a white crystal of the compound No. 7 having a melting point of from 117.5 to 119.0° C. was prepared.

Elemental Analysis Value (%)

| | C | H | N |
|---|---|---|---|
| Found value | 83.13 | 6.01 | 3.16 |
| Calculated value | 83.02 | 6.00 | 3.33 |

Examples A1 to A18 and Comparative Examples 1 to 5

Example A1

An undercoat coating liquid, a charge generation coating liquid and charge transport coating liquid, which have the following formulations, were coated and dried in this order on an aluminum cylinder having a diameter of 40 mm to form an undercoat layer 3.5 μm thick, a charge generation layer 0.2 μm thick, a charge transport layer 23 μm thick thereon. After each of the layers was dried in touch, each of them was dried at 130, 95 and 120° C. for 20 min, respectively.

Then, after a protection layer coating liquid having the following formulation, a filler was coated thereon by a spray gun MP-200C from Olympos at a pressure of 4 kgf/cm$^2$ and a distance between a nozzle of the spray gun and a photoreceptor of 10 cm.

The protection layer was cured by a UV lamp (H bulb) system from FUSION at a lamp power of 200 W/cm, an irradiation intensity of 450 mW/cm$^2$ and an irradiation time of 30 sec. This process fixed the filler at the surface of the protection layer while a part thereof was exposed thereon.

Then, all the layers were dried at 130° C. for 20 min to prepare an electrophotographic photoreceptor formed of the electroconductive substrate, the undercoat layer, the charge generation layer, the charge transport layer and the cured protection layer.

(Undercoat Layer Coating Liquid)

| | |
|---|---|
| Titanium oxide<br>(CR-EL having an average primary particle diameter about 0.25 μm from Ishihara Sangyo Kaisha Ltd.) | 50 |
| Alkyd resin<br>(BEKKOLITE M6401-50 including a solid content of 50% from Dainippon Ink And Chemicals, Inc.) | 14 |
| Melamine resin<br>(Super Bekkamin G821-60 from Dainippon Ink And Chemicals, inc.) | 8 |
| 2-butanon | 70 |

(Charge Generation Layer Coating Liquid)

Polyvinyl butyral resin was dissolved in 2-butanon solution. The solution was mixed with titanylphthalocyanine crystal and the mixture was subjected to a dispersion treatment for 30 minutes using a beads mill including PSZ balls having a diameter of 0.5 mm and rotating at a revolution of 1200 rpm to prepare a charge generation layer coating liquid.

| | |
|---|---|
| Titanylphthalocyanine crystal | 15 |
| Polyvinyl butyral<br>(BX-1 from Sekisui Chemical Co., Ltd.) | 10 |
| 2-butanone | 280 |

(Charge Transport Layer Coating Liquid)

| | |
|---|---|
| Bisphenol Z type Polycarbonate (PC) (Panlite TS2050 from Teijin Chemicals Ltd.) | 10 |
| Charge transport material having the following formula | 7 |

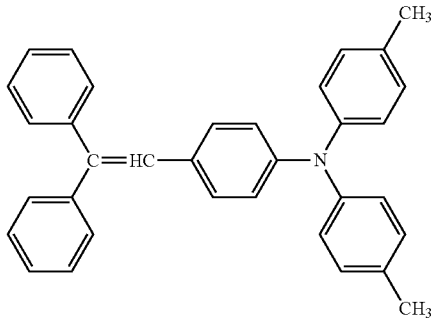

CTM-1

-continued

| | |
|---|---|
| Tetrahydrofuran | 68 |
| Tetrahydrofuran solution of 1% silicone oil (KF50-1CS from Shin-Etsu Chemical Co., Ltd.) | 0.2 |

(Cured Protection Layer Coating Liquid)

| | |
|---|---|
| Radical polymerizable compound<br>Trimethylolpropane triacrylate (KAYARAD TMPTA from Nippon Kayaku Co., Ltd.) being trifunctional, and having a molecular weight of 296 and a ratio of the molecular weight to the functional group number of 99 | 10 |
| Radical polymerizable compound<br>having a charge transport structure No. 7 | 10 |
| Photopolymerization initiator<br>1-hydroxy-cyclohexyl-phenyl-ketone (Irgacure 184, from Ciba Specialty Chemicals) | 1 |
| Solvent | |
| Tetrahydrofuran | 119 |

(Filler to be Coated)

Particulate silicone resin having an average particle diameter of 0.5 μm (TOSPEARL 105 from Momentive Performance Materials, Inc.)

Example A2

The procedure for preparation of the electrophotographic photoreceptor in Example A1 was repeated except for replacing the filler with a material F-A2 in Table 4A-1.

Example A3

The procedure for preparation of the electrophotographic photoreceptor in Example A1 was repeated except for replacing the filler with a material F-A3 in Table 4A-1.

Example A4

The procedure for preparation of the electrophotographic photoreceptor in Example A1 was repeated except for replacing the radical polymerizable compound with the following mixture.

| | |
|---|---|
| Radical polymerizable compound 1<br>Trimethylolpropane triacrylate (KAYARAD TMPTA, from Nippon Kayaku Co., Ltd.) being trifunctional, and having a molecular weight of 296 and a ratio of the molecular weight to the functional group number of 99 | 5 |
| Radical polymerizable compound 2<br>Caprolactone-modified dipentaerythritol hexaacrylate (KAYARAD DPCA-120 from Nippon Kayaku Co., Ltd., having molecular weight (M) of 1947, six functional groups (F) and a ratio (M/F) of 325. | 5 |

Example A5

The procedure for preparation of the electrophotographic photoreceptor in Example A4 was repeated except for replacing the filler with a material F-A2 in Table 4A-1.

Example A6

The procedure for preparation of the electrophotographic photoreceptor in Example A4 was repeated except for replacing the filler with a material F-A3 in Table 4A-1.

Example A6

The procedure for preparation of the electrophotographic photoreceptor in Example A1 was repeated except for replacing the cured protection layer coating liquid with one having the following formulation and changing the distance between the nozzle of the spray gun and the photoreceptor to 20 cm.

(Cured Protection Layer Coating Liquid)

| | |
|---|---|
| Radical polymerizable compound<br>Trimethylolpropane triacrylate (KAYARAD TMPTA from Nippon Kayaku Co., Ltd.) being trifunctional, and having a molecular weight of 296 and a ratio of the molecular weight to the functional group number of 99 | 10 |
| Charge transport material<br>Tin oxide (T-1 from Mitsubishi Materials Electronic Chemicals Co., Ltd., having a primary particle diameter of 0.02 μm) | 2.5 |
| Photopolymerization initiator<br>1-hydroxy-cyclohexyl-phenyl-ketone (Irgacure 184 from Ciba Specialty Chemicals) | 1 |
| Solvent | |
| Tetrahydrofuran | 76.5 |
| (Filler)<br>Chemisnow MX180TA from Soken Chemical & Engineering Co., Ltd., being a crosslinked acrylic particulate resin having a diameter of 2 μm | |

Examples A8 to A18

Electrophotographic photoreceptors were prepared with the materials and on the conditions shown in Table 4A-2.

(Cured Protection Layer Coating Liquid)

| | |
|---|---|
| Radical polymerizable compound<br>Trimethylolpropane triacrylate (KAYARAD TMPTA from Nippon Kayaku Co., Ltd.) being trifunctional, and having a molecular weight of 296 and a ratio of the molecular weight to the functional group number of 99 | 10 |
| Charge transport material<br>Tin oxide (T-1 from Mitsubishi Materials Electronic Chemicals Co., Ltd., having a primary particle diameter of 0.02 μm) | 2.5 |
| Photopolymerization initiator<br>1-hydroxy-cyclohexyl-phenyl-ketone (Irgacure 184 from Ciba Specialty Chemicals) | 0.5 |
| Solvent | |
| Tetrahydrofuran | 76.5 |

Comparative Example A1

After a cured protection layer coating liquid having the following formulation was coated on an electroconductive substrate, the liquid was cured by a UV lamp (H bulb) system from FUSION at a lamp power of 200 W/cm, an irradiation intensity of 450 mW/cm$^2$ and an irradiation time of 30 sec. Then, all the layers were dried at 130° C. for 20 min to prepare an electrophotographic photoreceptor formed of the electroconductive substrate, the undercoat layer, the charge generation layer, the charge transport layer and the cured protection layer. Then, a filler was buried on the following conditions.

(Cured Protection Layer Coating Liquid)

| | |
|---|---|
| Radical polymerizable compound<br>Caprolactone-modified dipentaerythritol hexaacrylate (KAYARAD DPCA-120 from Nippon Kayaku Co., Ltd., having molecular weight (M) of 1947, six functional groups (F) and a ratio (M/F) of 325. | 10 |
| Radical polymerizable compound<br>having a charge transport structure No. 7 | 10 |
| Photopolymerization initiator<br>1-hydroxy-cyclohexyl-phenyl-ketone (Irgacure 184, from Ciba Specialty Chemicals) | 1 |
| Solvent | |
| Tetrahydrofuran | 119 |

(Filler)

Particulate alumina

AA-2 from Sumitomo Chemical Co., Ltd., having an average particle diameter of 2 μm (F-A6)

(Used Apparatus)

PNEUMABLASTER 3G-4ATCM from Fuji Seisakusho K. K.

Gun traveling speed: 240 mm/min

Spray pressure: 3.5 kgd/cm$^2$

Distance between photoreceptor and gun: 100 mm

Photoreceptor rotational speed: 240 rpm

Discharge angle: 90°

Spray times: Twice

Comparative Example A2

The procedure for preparation of the electrophotographic photoreceptor in Example A7 was repeated except for replacing the radical polymerizable compound with the following one and changing the distance between the nozzle of the spray gun and the photoreceptor to 10 cm.

Radical polymerizable compound 1,6-hexanedioldiacrylate (A-HD-N from Shin-Nakamura Chemical Co., Ltd., having molecular weight (M) of 226, two functional groups (F) and a ratio (M/F) of 113.

Comparative Example A3

After a cured protection layer coating liquid having the following formulation was coated on an electroconductive substrate, the liquid was cured by a UV lamp (H bulb) system from FUSION at a lamp power of 200 W/cm, an irradiation intensity of 450 mW/cm$^2$ and an irradiation time of 30 sec. Then, all the layers were dried at 130° C. for 20 min to prepare an electrophotographic photoreceptor formed of the electroconductive substrate, the undercoat layer, the charge generation layer, the charge transport layer and the cured protection layer.

(Cured Protection Layer Coating Liquid)

| | |
|---|---|
| Radical polymerizable compound<br>Trimethylolpropane triacrylate (KAYARAD TMPTA from Nippon Kayaku Co., Ltd.) being trifunctional, and having a molecular weight of 296 and a ratio of the molecular weight to the functional group number of 99 | 20 |

-continued

| | |
|---|---|
| Photopolymerization initiator<br>1-hydroxy-cyclohexyl-phenyl-ketone (Irgacure 184, from Ciba Specialty Chemicals) | 1 |
| Filler (F-A1) | |
| Particulate silicone resin<br>having an average particle diameter of 0.5 μm<br>(TOSPEARL 105 from Momentive Performance Materials, Inc.) | 2 |
| Solvent | |
| Tetrahydrofuran | 119 |

Comparative Example A4

The procedure for preparation of the electrophotographic photoreceptor in Comparative Example A3 was repeated except for replacing the filler with the following filler.

Particulate PTFE having a average particle diameter of 3.0 μm.

(Lubron L-2 from DAIKIN INDUSTRIES, Ltd.)

After a protection layer coating liquid having the following formulation was coated on an electrophotographic photoreceptor formed of the electroconductive substrate, the undercoat layer, the charge generation layer, the charge transport layer, a filler was coated thereon by a spray gun MP-200C from Olympos at a pressure of 4 kgf/cm$^2$ and a distance between a nozzle of the spray gun and a photoreceptor of 10 cm. Then, all the layers were dried at 130° C. for 20 min to prepare an electrophotographic photoreceptor formed of the electroconductive substrate, the undercoat layer, the charge generation layer, the charge transport layer and the protection layer.

(Protection Layer Coating Liquid)

| | |
|---|---|
| Bisphenol Z type Polycarbonate (PC) (Panlite TS2050 from Teijin Chemicals Ltd.) | 10 |
| Charge transport material having the following formula | 7 |

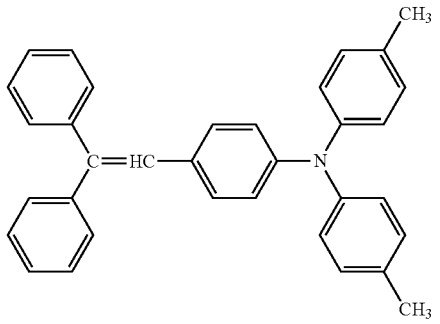

CTM-1

| | |
|---|---|
| Tetrahydrofuran | 34 |
| Cyclohexanone | 34 |
| (Filler to be coated)<br>Particulate silicone resin having an average particle diameter of 2 μm (TOSPEARL 120 from Momentive Performance Materials, Inc.) | |

The formulations of the electrophotographic photoreceptors are shown in Table 4A-2. Filler Nos. therein are fillers in Table 4A-1.

TABLE 4A-1

| Filler No. | Filler Name | Material | Average particle diameter (μm) |
|---|---|---|---|
| F-A1 | TOSPEARL 105 from Momentive Performance Materials, Inc.) | Particulate silicone resin | 0.5 |
| F-A2 | TOSPEARL 120 from Momentive Performance Materials, Inc.) | Particulate silicone resin | 2 |
| F-A3 | Lubron L-2 from DAIKIN INDUSTRIES, Ltd. | Particulate PTFE | 3 |
| F-A4 | Chemisnow MX180TA from Soken Chemical & Engineering Co., Ltd., | Crosslinked acrylic particulate resin | 2 |
| F-A5 | OPTOBEADS 200M from Nissan Chemical Industries, Ltd. | Particulate melamine resin | 2 |
| F-A6 | AA-2 from Sumitomo Chemical Co., Ltd., | Particulate alumina | 2 |

Examples B1 to B20 and Comparative Examples B1 to B5

Example B1

An undercoat coating liquid, a charge generation coating liquid and charge transport coating liquid, which have the following formulations, were coated and dried in this order on an aluminum cylinder having a diameter of 40 mm to form an undercoat layer 3.5 μm thick, a charge generation layer 0.2 μm thick, a charge transport layer 23 μm thick thereon. After each of the layers was dried in touch, each of them was dried at 130, 95 and 120° C. for 20 min, respectively.

Then, after a protection layer coating liquid having the following formulation and including a filler, the filler was coated thereon by a spray gun MP-200C from Olympos at a pressure of 4 kgf/cm$^2$ and a distance between a nozzle of the spray gun and a photoreceptor of 10 cm.

The protection layer was cured by a UV lamp (H bulb) system from FUSION at a lamp power of 200 W/cm, an irradiation intensity of 450 mW/cm$^2$ and an irradiation time of 30 sec. This process fixed the filler at the surface of the protection layer while a part thereof was exposed thereon.

Then, all the layers were dried at 130° C. for 20 min to prepare an electrophotographic photoreceptor formed of the

TABLE 4A-2

| | Radical polymerizable compound 1 | Radical polymerizable compound 2 | Charge transport material | Filler | Protection layer thickness (μm) | Spray pressure (kgf/cm$^2$) | Nozzle-photo-receptor distance |
|---|---|---|---|---|---|---|---|
| Example A1 | TMPTA | None | No. 7 | F-A1 | 4.6 | 4 | 10 |
| Example A2 | TMPTA | None | No. 7 | F-A2 | 4.7 | 4 | 10 |
| Example A3 | TMPTA | DPCA-120 | No. 7 | F-A3 | 5.1 | 4 | 10 |
| Example A4 | TMPTA | DPCA-120 | No. 7 | F-A1 | 4.6 | 4 | 10 |
| Example A5 | TMPTA | DPCA-120 | No. 7 | F-A2 | 4.5 | 4 | 10 |
| Example A6 | TMPTA | None | No. 7 | F-A3 | 4.7 | 4 | 10 |
| Example A7 | TMPTA | None | Tin oxide | F-A4 | 1.6 | 4 | 20 |
| Example A8 | TMPTA | None | Tin oxide | F-A4 | 1.4 | 4 | 5 |
| Example A9 | TMPTA | None | Tin oxide | F-A4 | 1.3 | 4 | 15 |
| Example A10 | TMPTA | None | Tin oxide | F-A4 | 1.7 | 4 | 7 |
| Example A11 | TMPTA | None | Tin oxide | F-A4 | 1.8 | 4 | 10 |
| Example A12 | TMPTA | None | Tin oxide | F-A4 | 1.5 | 4 | 10 |
| Example A13 | TMPTA | None | Tin oxide | F-A4 | 1.5 | 4 | 10 |
| Example A14 | TMPTA | None | Tin oxide | F-A4 | 1.5 | 4 | 10 |
| Example A15 | TMPTA | None | Tin oxide | F-A4 | 1.0 | 4 | 10 |
| Example A16 | TMPTA | None | Tin oxide | F-A2 | 1.1 | 4 | 10 |
| Example A17 | TMPTA | None | Tin oxide | F-A3 | 0.7 | 4 | 10 |
| Example A18 | TMPTA | None | Tin oxide | F-A5 | 1.2 | 4 | 10 |
| Comparative Example A1 | DPCA-120 | None | No. 7 | F-A6 | 5.6 | — | — |
| Comparative Example A2 | A-HD-N | None | Tin oxide | F-A4 | 1.3 | 4 | 10 |
| Comparative Example A3 | TMPTA | None | No. 7 | F-A2 (dispersion) | 5.4 | — | — |
| Comparative Example A4 | TMPTA | None | No. 7 | F-A3 (dispersion) | 5.1 | — | — |
| Comparative Example A5 | PC* | None | CTM-1 | F-A2 | 4.5 | 4 | 10 |

*PC is a non-radical polymerizable compound electroconductive substrate, the undercoat layer, the charge generation layer, the charge transport layer and the cured protection layer.

(Undercoat Layer Coating Liquid)

| | |
|---|---|
| Titanium oxide<br>(CR-EL having an average primary particle diameter about 0.25 μm from Ishihara Sangyo Kaisha Ltd.) | 50 |
| Alkyd resin<br>(BEKKOLITE M6401-50 including a solid content of 50% from Dainippon Ink And Chemicals, Inc.) | 14 |
| Melamine resin<br>(Super Bekkamin G821-60 from Dainippon Ink And Chemicals, inc.) | 8 |
| 2-butanon | 70 |

(Charge Generation Layer Coating Liquid)

Polyvinyl butyral resin was dissolved in 2-butanon solution. The solution was mixed with titanylphthalocyanine crystal and the mixture was subjected to a dispersion treatment for 30 minutes using a beads mill including PSZ balls having a diameter of 0.5 mm and rotating at a revolution of 1200 rpm to prepare a charge generation layer coating liquid.

| | |
|---|---|
| Titanylphthalocyanine crystal | 15 |
| Polyvinyl butyral<br>(BX-1 from Sekisui Chemical Co., Ltd.) | 10 |
| 2-butanone | 280 |

(Charge Transport Layer Coating Liquid)

| | |
|---|---|
| Bisphenol Z type Polycarbonate (PC)<br>(Panlite TS2050 from Teijin Chemicals Ltd.) | 10 |
| Charge transport material having the following formula | 7 |

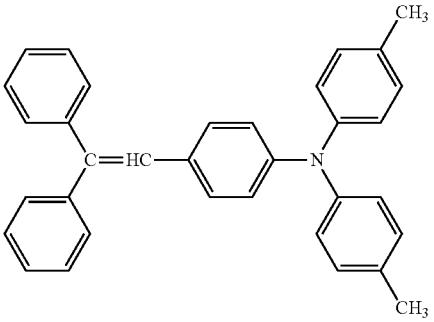

CTM-1

| | |
|---|---|
| Tetrahydrofuran | 68 |
| Tetrahydrofuran solution of 1% silicone oil<br>(KF50-1CS from Shin-Etsu Chemical Co., Ltd.) | 0.2 |

(Cured Protection Layer Coating Liquid)

| | |
|---|---|
| Radical polymerizable compound<br>Trimethylolpropane triacrylate (KAYARAD TMPTA from Nippon Kayaku Co., Ltd.) being trifunctional, and having a molecular weight of 296 and a ratio of the molecular weight to the functional group number of 99 | 10 |
| Radical polymerizable compound<br>having a charge transport structure No. 7 | 10 |

-continued

| | |
|---|---|
| Photopolymerization initiator<br>1-hydroxy-cyclohexyl-phenyl-ketone (Irgacure 184, from Ciba Specialty Chemicals) | 1 |
| Filler | |
| Alumina filler<br>(SUMICORUNDUM AA-05 having an average particle diameter of 0.5 μm from Sumitomo Chemical Co., Ltd.) | 2 |
| Solvent | |
| Tetrahydrofuran | 130 |

(Filler to be Coated)

Particulate silicone resin having an average particle diameter of 0.5 μm (TOSPEARL 105 from Momentive Performance Materials, Inc.)

Example B2

The procedure for preparation of the electrophotographic photoreceptor in Example B1 was repeated except for replacing the filler to be coated with a material F-B2 in Table 4B-1.

Example B3

The procedure for preparation of the electrophotographic photoreceptor in Example B1 was repeated except for replacing the filler to be coated with a material F-B3 in Table 4B-1.

Example B4

The procedure for preparation of the electrophotographic photoreceptor in Example B1 was repeated except for replacing the cured protection layer coating liquid with one having the following formulation.

(Cured Protection Layer Coating Liquid)

| | |
|---|---|
| Radical polymerizable compound 1<br>Trimethylolpropane triacrylate (KAYARAD TMPTA from Nippon Kayaku Co., Ltd.) being trifunctional, and having a molecular weight of 296 and a ratio of the molecular weight to the functional group number of 99 | 5 |
| Radical polymerizable compound 2<br>Caprolactone-modified dipentaerythritol hexaacrylate (KAYARAD DPCA-120 from Nippon Kayaku Co., Ltd., having molecular weight (M) of 1947, six functional groups (F) and a ratio (M/F) of 325. | 5 |
| Radical polymerizable compound<br>having a charge transport structure No. 7 | 10 |
| Photopolymerization initiator<br>1-hydroxy-cyclohexyl-phenyl-ketone (Irgacure 184, from Ciba Specialty Chemicals) | 1 |
| Filler | |
| Alumina filler<br>(SUMICORUNDUM AA-03 having an average particle diameter of 0.3 μm from Sumitomo Chemical Co., Ltd.) | 2 |
| Solvent | |
| Tetrahydrofuran | 130 |

(Filler to be Coated)

Particulate silicone resin having an average particle diameter of 0.5 μm (TOSPEARL 105 from Momentive Performance Materials, Inc.)

Example B5

The procedure for preparation of the electrophotographic photoreceptor in Example B4 was repeated except for replacing the filler to be coated with a material F-B2 in Table 4B-1.

Example B6

The procedure for preparation of the electrophotographic photoreceptor in Example B4 was repeated except for replacing the filler to be coated with a material F-B3 in Table 4B-1.

Example B7

The procedure for preparation of the electrophotographic photoreceptor in Example B1 was repeated except for replacing the cured protection layer coating liquid with one having the following formulation and changing the powder coating conditions into those shown in Table 4B-1.

(Cured Protection Layer Coating Liquid)

| | |
|---|---|
| Radical polymerizable compound<br>Trimethylolpropane triacrylate (KAYARAD TMPTA from Nippon Kayaku Co., Ltd.) being trifunctional, and having a molecular weight of 296 and a ratio of the molecular weight to the functional group number of 99 | 10 |
| Charge transport material | 2.5 |
| Tin oxide (T-1 from Mitsubishi Materials Electronic Chemicals Co., Ltd., having a primary particle diameter of 0.02 μm) | |
| Photopolymerization initiator<br>1-hydroxy-cyclohexyl-phenyl-ketone (Irgacure 184 from Ciba Specialty Chemicals) | 1 |
| Filler | |
| Titanium oxide<br>(CR-EL having an average primary particle diameter about 0.25 μm from Ishihara Sangyo Kaisha Ltd.) | 1 |
| Solvent | |
| Tetrahydrofuran | 90 |

(Filler)

Chemisnow MX180TA from Soken Chemical & Engineering Co., Ltd., being a crosslinked acrylic particulate resin having a diameter of 2 μm Examples B8 to B20

Electrophotographic photoreceptors were prepared with the materials and on the conditions shown in Table 4B-2. Filler Nos. therein are fillers in Table 4B-1. Cured protection layers in Examples B8 to B18 had the following formulation. Examples B19 and B20 used AA-03 and AA-04 as fillers, respectively.

(Cured Protection Layer Coating Liquid)

| | |
|---|---|
| Radical polymerizable compound<br>Trimethylolpropane triacrylate (KAYARAD TMPTA from Nippon Kayaku Co., Ltd.) being trifunctional, and having a molecular weight of 296 and a ratio of the molecular weight to the functional group number of 99 | 10 |

-continued

| | |
|---|---|
| Charge transport material | 2.5 |
| Tin oxide (T-1 from Mitsubishi Materials Electronic Chemicals Co., Ltd., having a primary particle diameter of 0.02 μm) | |
| Photopolymerization initiator<br>1-hydroxy-cyclohexyl-phenyl-ketone (Irgacure 184 from Ciba Specialty Chemicals) | 1 |
| Filler | |
| Titanium oxide<br>(CR-EL having an average primary particle diameter about 0.25 μm from Ishihara Sangyo Kaisha Ltd.) | 1 |
| Solvent | |
| Tetrahydrofuran | 90 |

Comparative Example B1

After a cured protection layer coating liquid having the following formulation was coated on an electroconductive substrate, the liquid was cured by a UV lamp (H bulb) system from FUSION at a lamp power of 200 W/cm, an irradiation intensity of 450 mW/cm$^2$ and an irradiation time of 30 sec. Then, all the layers were dried at 130° C. for 20 min to prepare an electrophotographic photoreceptor formed of the electroconductive substrate, the undercoat layer, the charge generation layer, the charge transport layer and the cured protection layer. Then, a filler was buried on the following conditions.

(Cured Protection Layer Coating Liquid)

| | |
|---|---|
| Radical polymerizable compound<br>Caprolactone-modified dipentaerythritol hexaacrylate (KAYARAD DPCA-120 from Nippon Kayaku Co., Ltd., having molecular weight (M) of 1947, six functional groups (F) and a ratio (M/F) of 325. | 10 |
| Radical polymerizable compound<br>having a charge transport structure No. 7 | 10 |
| Photopolymerization initiator<br>1-hydroxy-cyclohexyl-phenyl-ketone (Irgacure 184, from Ciba Specialty Chemicals) | 1 |
| Filler | |
| Titanium oxide<br>(CR-EL having an average primary particle diameter about 0.25 μm from Ishihara Sangyo Kaisha Ltd.) | 1 |
| Solvent | |
| Tetrahydrofuran | 119 |

(Filler)

Particulate alumina

AA-2 from Sumitomo Chemical Co., Ltd., having an average particle diameter of 2 μm (F-B6)

(Used Apparatus)

PNEUMABLASTER 3G-4ATCM from Fuji Seisakusho K. K.

Gun traveling speed: 240 mm/min

Spray pressure: 3.5 kgd/cm$^2$

Distance between photoreceptor and gun: 100 mm

Photoreceptor rotational speed: 240 rpm

Discharge angle: 90°

Spray times: Twice

Comparative Example B2

The procedure for preparation of the electrophotographic photoreceptor in Example B7 was repeated except for replacing the radical polymerizable compound with the following one and changing the distance between the nozzle of the spray gun and the photoreceptor to 10 cm.

Radical Polymerizable Compound 1,6-hexanedioldiacrylate (A-HD-N from Shin-Nakamura Chemical Co., Ltd., having molecular weight (M) of 226, two functional groups (F) and a ratio (M/F) of 113.

Comparative Example B3

The procedure for preparation of the electrophotographic photoreceptor in Example B1 was repeated except for replacing the cured protection layer coating liquid with one having the following formulation.

(Cured Protection Layer Coating Liquid)

| | |
|---|---|
| Radical polymerizable compound 1<br>Trimethylolpropane triacrylate (KAYARAD TMPTA from Nippon Kayaku Co., Ltd.) being trifunctional, and having a molecular weight of 296 and a ratio of the molecular weight to the functional group number of 99 | 5 |
| Radical polymerizable compound 2<br>Caprolactone-modified dipentaerythritol hexaacrylate (KAYARAD DPCA-120 from Nippon Kayaku Co., Ltd., having molecular weight (M) of 1947, six functional groups (F) and a ratio (M/F) of 325. | 5 |
| Radical polymerizable compound<br>having a charge transport structure No. 7 | 10 |
| Photopolymerization initiator<br>1-hydroxy-cyclohexyl-phenyl-ketone (Irgacure 184, from Ciba Specialty Chemicals) | 1 |
| Filler | |
| Alumina filler<br>(SUMICORUNDUM AA-03 having an average particle diameter of 0.3 μm from Sumitomo Chemical Co., Ltd.) | 2 |
| Solvent | |
| Tetrahydrofuran | 119 |

Comparative Example B4

The procedure for preparation of the electrophotographic photoreceptor in Example B1 was repeated except for replacing the cured protection layer coating liquid with one having the following formulation.

(Cured Protection Layer Coating Liquid)

| | |
|---|---|
| Radical polymerizable compound<br>Trimethylolpropane triacrylate (KAYARAD TMPTA from Nippon Kayaku Co., Ltd.) being trifunctional, and having a molecular weight of 296 and a ratio of the molecular weight to the functional group number of 99 | 10 |
| Radical polymerizable compound<br>having a charge transport structure No. 7 | 10 |
| Photopolymerization initiator<br>1-hydroxy-cyclohexyl-phenyl-ketone (Irgacure 184, from Ciba Specialty Chemicals) | 1 |
| Filler | |
| Alumina filler<br>(SUMICORUNDUM AA-03 having an average particle diameter of 0.3 μm from Sumitomo Chemical Co., Ltd.) | 2 |
| Filler | |
| Silicone filler<br>(TOSPEARL 105 having an average particle diameter of 0.5 μm from Momentive Performance Materials, Inc.) | |
| Solvent | |
| Tetrahydrofuran | 130 |

The formulations of the electrophotographic photoreceptors are shown in Tables 4B-2(1) and 4B-2(2). Filler Nos. therein are fillers in Table 4B-1.

TABLE 4B-1

| Filler No. | Filler Name | Material | Average particle diameter (μm) |
|---|---|---|---|
| F-B1 | TOSPEARL 105 from Momentive Performance Materials, Inc.) | Particulate silicone resin | 0.5 |
| F-B2 | TOSPEARL 120 from Momentive Performance Materials, Inc.) | Particulate silicone resin | 2 |
| F-B3 | Lubron L-2 from DAIKIN INDUSTRIES, Ltd. | Particulate PTFE | 3 |
| F-B4 | Chemisnow MX180TA from Soken Chemical & Engineering Co., Ltd., | Crosslinked acrylic particulate resin | 2 |
| F-B5 | OPTOBEADS 200M from Nissan Chemical Industries, Ltd. | Particulate melamine resin | 2 |
| F-B6 | AA-2 from Sumitomo Chemical Co., Ltd., | Particulate alumina | 2 |

TABLE 4B-2(1)

| | Radical polymerizable compound 1 | Radical polymerizable compound 2 | Charge transport material | Filler included | Exposed filler |
|---|---|---|---|---|---|
| Example B1 | TMPTA | None | No. 7 | AA-05 | F-B1 |
| Example B2 | TMPTA | None | No. 7 | AA-05 | F-B2 |
| Example B3 | TMPTA | None | No. 7 | AA-05 | F-B3 |
| Example B4 | TMPTA | DPCA-120 | No. 7 | AA-03 | F-B1 |
| Example B5 | TMPTA | DPCA-120 | No. 7 | AA-03 | F-B2 |
| Example B6 | TMPTA | DPCA-120 | No. 7 | AA-03 | F-B3 |
| Example B7 | TMPTA | None | Tin oxide | CR-EL | F-B4 |
| Example B8 | TMPTA | None | Tin oxide | CR-EL | F-B4 |
| Example B9 | TMPTA | None | Tin oxide | CR-EL | F-B4 |
| Example B10 | TMPTA | None | Tin oxide | CR-EL | F-B4 |
| Example B11 | TMPTA | None | Tin oxide | CR-EL | F-B4 |
| Example B12 | TMPTA | None | Tin oxide | CR-EL | F-B4 |
| Example B13 | TMPTA | None | Tin oxide | CR-EL | F-B4 |
| Example B14 | TMPTA | None | Tin oxide | CR-EL | F-B4 |
| Example B15 | TMPTA | None | Tin oxide | CR-EL | F-B4 |

TABLE 4B-2(1)-continued

| | Radical polymerizable compound 1 | Radical polymerizable compound 2 | Charge transport material | Filler included | Exposed filler |
|---|---|---|---|---|---|
| Example B16 | TMPTA | None | Tin oxide | CR-EL | F-B2 |
| Example B17 | TMPTA | None | Tin oxide | CR-EL | F-B3 |
| Example B18 | TMPTA | None | Tin oxide | CR-EL | F-B5 |
| Example B19 | TMPTA | None | Tin oxide | AA-03 | F-B2 |
| Example B20 | TMPTA | None | Tin oxide | AA-05 | F-B2 |
| Comparative Example B1 | DPCA-120 | None | No. 7 | CR-EL | FB-6 |
| Comparative Example B2 | A-HD-N | None | Tin oxide | CR-EL | F-B4 |
| Comparative Example B3 | TMPTA | None | No. 7 | AA-03 | None |
| Comparative Example B4 | TMPTA | None | No. 7 | AA-03 TP-105 | None |

TABLE 4B-2(2)

| | Protection layer thickness (μm) | Spray pressure (kgf/cm$^2$) | Nozzle-photo-receptor distance | No. of spray |
|---|---|---|---|---|
| Example B1 | 4.4 | 4 | 10 | 4 |
| Example B2 | 4.5 | 4 | 10 | 4 |
| Example B3 | 4.8 | 4 | 10 | 4 |
| Example B4 | 4.4 | 4 | 10 | 4 |
| Example B5 | 4.3 | 4 | 10 | 4 |
| Example B6 | 4.5 | 4 | 10 | 4 |
| Example B7 | 1.5 | 4 | 20 | 4 |
| Example B8 | 1.3 | 4 | 5 | 4 |
| Example B9 | 1.2 | 4 | 15 | 4 |
| Example B10 | 1.6 | 4 | 7 | 4 |
| Example B11 | 1.7 | 4 | 10 | 1 |
| Example B12 | 1.4 | 4 | 10 | 7 |
| Example B13 | 1.4 | 4 | 10 | 2 |
| Example B14 | 1.4 | 4 | 10 | 6 |
| Example B15 | 1.0 | 4 | 10 | 4 |
| Example B16 | 1.0 | 4 | 10 | 4 |
| Example B17 | 0.7 | 4 | 10 | 4 |
| Example B18 | 1.1 | 4 | 10 | 4 |
| Example B19 | 1.0 | 4 | 10 | 4 |
| Example B20 | 1.3 | 4 | 10 | 4 |
| Comparative Example B1 | 5.3 | — | — | — |
| Comparative Example B2 | 1.2 | 4 | 10 | 4 |
| Comparative Example B3 | 5.1 | — | — | — |
| Comparative Example B4 | 4.3 | — | — | — |

Examples C1 to C23

Example C1

An undercoat coating liquid, a charge generation coating liquid and charge transport coating liquid, which have the following formulations, were coated and dried in this order on an aluminum cylinder having a diameter of 40 mm to form an undercoat layer 3.5 μm thick, a charge generation layer 0.2 μm thick, a charge transport layer 23 μm thick thereon. After each of the layers was dried in touch, each of them was dried at 130, 95 and 120° C. for 20 min, respectively.

Then, after a protection layer coating liquid having the following formulation, two fillers were coated thereon by a spray gun MP-200C from Olympos at a pressure of 4 kgf/cm$^2$ and a distance between a nozzle of the spray gun and a photoreceptor of 10 cm.

The protection layer was cured by a UV lamp (H bulb) system from FUSION at a lamp power of 200 W/cm, an irradiation intensity of 450 mW/cm$^2$ and an irradiation time of 30 sec. This process fixed the filler at the surface of the protection layer while a part thereof was exposed thereon.

Then, all the layers were dried at 130° C. for 20 min to prepare an electrophotographic photoreceptor formed of the electroconductive substrate, the undercoat layer, the charge generation layer, the charge transport layer and the cured protection layer.

(Undercoat Layer Coating Liquid)

| | |
|---|---|
| Titanium oxide (CR-EL having an average primary particle diameter about 0.25 μm from Ishihara Sangyo Kaisha Ltd.) | 50 |
| Alkyd resin (BEKKOLITE M6401-50 including a solid content of 50% from Dainippon Ink And Chemicals, Inc.) | 14 |
| Melamine resin (Super Bekkamin G821-60 from Dainippon Ink And Chemicals, inc.) | 8 |
| 2-butanon | 70 |

(Charge Generation Layer Coating Liquid)

Polyvinyl butyral resin was dissolved in 2-butanon solution. The solution was mixed with titanylphthalocyanine crystal and the mixture was subjected to a dispersion treatment for 30 minutes using a beads mill including PSZ balls having a diameter of 0.5 mm and rotating at a revolution of 1200 rpm to prepare a charge generation layer coating liquid.

| | |
|---|---|
| Titanylphthalocyanine crystal | 15 |
| Polyvinyl butyral (BX-1 from Sekisui Chemical Co., Ltd.) | 10 |
| 2-butanone | 280 |

(Charge Transport Layer Coating Liquid)

| | |
|---|---|
| Bisphenol Z type Polycarbonate (PC) (Panlite TS2050 from Teijin Chemicals Ltd.) | 10 |
| Charge transport material having the following formula | 7 |

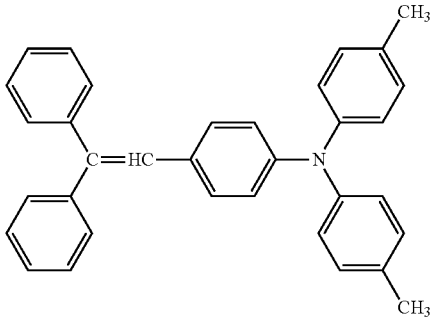

CTM-1

| | |
|---|---|
| Tetrahydrofuran | 68 |
| Tetrahydrofuran solution of 1% silicone oil (KF50-1CS from Shin-Etsu Chemical Co., Ltd.) | 0.2 |

(Cured Protection Layer Coating Liquid)

| | |
|---|---|
| Radical polymerizable compound | 10 |
| Trimethylolpropane triacrylate (KAYARAD TMPTA from Nippon Kayaku Co., Ltd.) being trifunctional, and having a molecular weight of 296 and a ratio of the molecular weight to the functional group number of 99 | |
| Radical polymerizable compound having a charge transport structure No. 7 | 10 |
| Photopolymerization initiator 1-hydroxy-cyclohexyl-phenyl-ketone (Irgacure 184, from Ciba Specialty Chemicals) | 1 |
| Solvent | |
| Tetrahydrofuran | 119 |

(Filler to be Coated)

Particulate silicone resin having an average particle diameter of 0.5 μm (TOSPEARL 105 from Momentive Performance Materials, Inc.)

Alumina filler having an average particle diameter of 0.7 μm (SUMICORUDUM AA-07 from Sumitomo Chemical Co., Ltd.)

Examples C2 to C23

Electrophotographic photoreceptors were prepared with the materials and on the conditions shown in Table 4C-2. Filler Nos. therein are fillers in Table 4C-1. Examples C4 to C6 used a mixture of each 5 parts of KAYARAD TMPTA from Nippon Kayaku Co., Ltd. and KAYARAD DPCA-120 from Nippon Kayaku Co., Ltd. having 6 functional groups. Cured protection layers in Examples C7 to C23 had the following formulation. Examples C24 used the same cured protection layer coating liquid as that of Example C1.

(Cured Protection Layer Coating Liquid)

| | |
|---|---|
| Radical polymerizable compound | 10 |
| Trimethylolpropane triacrylate (KAYARAD TMPTA from Nippon Kayaku Co., Ltd.) being trifunctional, and having a molecular weight of 296 and a ratio of the molecular weight to the functional group number of 99 | |
| Charge transport material | 2.5 |
| Tin oxide (T-1 from Mitsubishi Materials Electronic Chemicals Co., Ltd., having a primary particle diameter of 0.02 μm) | |
| Photopolymerization initiator 1-hydroxy-cyclohexyl-phenyl-ketone (Irgacure 184 from Ciba Specialty Chemicals) | 1 |
| Solvent | |
| Tetrahydrofuran | 70 |

Comparative Example C1

The procedure for preparation of the electrophotographic photoreceptor in Example C1 was repeated except for replacing the radical polymerizable compound with the following one.

Radical polymerizable compound 1,6-hexanedioldiacrylate (A-HD-N from Shin-Nakamura Chemical Co., Ltd., having two functional groups

Comparative Example C2

A filler was dispersed in the cured protection layer coating liquid, and the liquid was coated. Then, the protection layer was cured by a UV lamp (H bulb) system from FUSION at a lamp power of 200 W/cm, an irradiation intensity of 450 mW/cm$^2$ and an irradiation time of 30 sec. Then, all the layers were dried at 130° C. for 20 min to prepare an electrophotographic photoreceptor formed of the electroconductive substrate, the undercoat layer, the charge generation layer, the charge transport layer and the cured protection layer.

(Cured Protection Layer Coating Liquid)

| | |
|---|---|
| Radical polymerizable compound | 10 |
| Trimethylolpropane triacrylate (KAYARAD TMPTA from Nippon Kayaku Co., Ltd.) being trifunctional, and having a molecular weight of 296 and a ratio of the molecular weight to the functional group number of 99 | |
| Radical polymerizable compound having a charge transport structure No. 7 | 10 |
| Photopolymerization initiator 1-hydroxy-cyclohexyl-phenyl-ketone (Irgacure 184, from Ciba Specialty Chemicals) | 1 |
| Filler | |
| Alumina filler (SUMICORUNDUM AA-05 having an average particle diameter of 0.5 μm from Sumitomo Chemical Co., Ltd.) | 2 |
| Solvent | |
| Tetrahydrofuran | 130 |

Comparative Example C3

After a cured protection layer coating liquid having the following formulation was coated on an electroconductive substrate, the liquid was cured by a UV lamp (H bulb) system from FUSION at a lamp power of 200 W/cm, an irradiation intensity of 450 mW/cm$^2$ and an irradiation time of 30 sec.

Then, all the layers were dried at 130° C. for 20 min to prepare an electrophotographic photoreceptor formed of the electroconductive substrate, the undercoat layer, the charge generation layer, the charge transport layer and the cured protection layer. Then, a filler was buried on the following conditions.

(Cured Protection Layer Coating Liquid)

| | |
|---|---|
| Radical polymerizable compound<br>Caprolactone-modified dipentaerythritol hexaacrylate (KAYARAD DPCA-120 from Nippon Kayaku Co., Ltd., having molecular weight (M) of 1947, six functional groups (F) and a ratio (M/F) of 325. | 10 |
| Radical polymerizable compound having a charge transport structure No. 7 | 10 |
| Photopolymerization initiator<br>1-hydroxy-cyclohexyl-phenyl-ketone (Irgacure 184, from Ciba Specialty Chemicals) | 1 |
| Solvent<br>Tetrahydrofuran | 119 |

(Filler to be Coated)

Alumina filler (SUMICORUNDUM AA-1.5 from Sumitomo Chemical Co., Ltd., having an average particle diameter of 1.5 μm Silicone filler (TOSPEARL 120 from Momentive Performance Materials, Inc., having an average particle diameter of 2 μm)

(Used Apparatus)

PNEUMABLASTER 3G-4ATCM from Fuji Seisakusho K. K.

Gun traveling speed: 240 mm/min

Spray pressure: 3.5 kgd/cm$^2$

Distance between photoreceptor and gun: 100 mm

Photoreceptor rotational speed: 240 rpm

Discharge angle: 90°

Spray times: Twice

TABLE 4C-1

| Filler No. | Filler Name | Material | Average particle diameter (μm) |
|---|---|---|---|
| F-C1 | TOSPEARL 105 from Momentive Performance Materials, Inc.) | Particulate silicone resin | 0.5 |
| F-C2 | TOSPEARL 120 from Momentive Performance Materials, Inc.) | Particulate silicone resin | 2 |
| F-C3 | Lubron L-2 from DAIKIN INDUSTRIES, Ltd. | Particulate PTFE | 3 |
| F-C4 | AA-07 from Sumitomo Chemical Co., Ltd. | Particulate alumina | 0.7 |
| F-C5 | AA-1.5 from Sumitomo Chemical Co., Ltd. | Particulate alumina | 1.5 |
| F-C6 | CR-EL from Ishihara Sangyo Kaisha Ltd. | Particulate titanium oxide | 0.25 |
| F-C7 | AA-03 from Sumitomo Chemical Co., Ltd. | Particulate alumina | 0.3 |

TABLE 4C-2(1)

| | Radical polymerizable compound 1 | Radical polymerizable compound 2 | Charge transport material | Exposed filler 1 | Exposed filler 2 | Filler included | Protection layer thickness (μm) |
|---|---|---|---|---|---|---|---|
| Example C1 | TMPTA | None | No. 7 | F-C1 | F-C6 | None | 4.8 |
| Example C2 | TMPTA | None | No. 7 | F-C2 | F-C5 | None | 4.9 |
| Example C3 | TMPTA | None | No. 7 | F-C3 | F-C5 | None | 5.3 |
| Example C4 | TMPTA | DPCA-120 | No. 7 | F-C1 | F-C4 | None | 4.8 |
| Example C5 | TMPTA | DPCA-120 | No. 7 | F-C2 | F-C5 | None | 4.7 |
| Example C6 | TMPTA | DPCA-120 | No. 7 | F-C3 | F-C5 | None | 4.9 |
| Example C7 | TMPTA | None | Tin oxide | F-C2 | F-C5 | None | 4.6 |
| Example C8 | TMPTA | None | Tin oxide | F-C2 | F-C5 | None | 4.0 |
| Example C9 | TMPTA | None | Tin oxide | F-C2 | F-C5 | None | 3.7 |
| Example C10 | TMPTA | None | Tin oxide | F-C2 | F-C5 | None | 4.8 |
| Example C11 | TMPTA | None | Tin oxide | F-C2 | F-C5 | None | 5.1 |
| Example C12 | TMPTA | None | Tin oxide | F-C2 | F-C5 | None | 4.3 |
| Example C13 | TMPTA | None | Tin oxide | F-C2 | F-C5 | None | 4.3 |
| Example C14 | TMPTA | None | Tin oxide | F-C2 | F-C5 | None | 4.3 |
| Example C15 | TMPTA | None | Tin oxide | F-C2 | F-C5 | None | 4.7 |
| Example C16 | TMPTA | None | Tin oxide | F-C2 | F-C5 | None | 4.8 |
| Example C17 | TMPTA | None | Tin oxide | F-C2 | F-C5 | None | 4.6 |
| Example C18 | TMPTA | None | Tin oxide | F-C2 | F-C5 | None | 4.4 |
| Example C19 | TMPTA | None | Tin oxide | F-C1 | F-C2 | None | 4.2 |
| Example C20 | TMPTA | None | Tin oxide | F-C1 | F-C2 | None | 4.4 |
| Example C21 | TMPTA | None | Tin oxide | F-C1 | F-C2 | None | 4.5 |
| Example C22 | TMPTA | None | Tin oxide | F-C2 | F-C5 | None | 4.1 |
| Example C23 | TMPTA | None | Tin oxide | F-C3 | F-C5 | None | 4.7 |
| Example C24 | TMPTA | None | No. 7 | F-C1 | F-C2 | None | 4.8 |
| Example C25 | TMPTA | None | No. 7 | F-C1 | F-C6 | F-C7 | 4.8 |
| Comparative Example C1 | A-HD-N | None | No. 7 | F-C1 | F-C4 | None | 3.8 |
| Comparative Example C2 | TMPTA | None | No. 7 | None | None | F-C1<br>F-C4 | 4.3 |
| Comparative Example C3 | DPCA-120 | None | No. 7 | F-C2 | F-C5 | None | 4.5 |

TABLE 4C-2(2)

| | Exposed Filler 1 | | | Exposed Filler 2 | | |
|---|---|---|---|---|---|---|
| | Spray pressure (kgf/cm$^2$) | Nozzle-photo-receptor distance | No. of spray | Spray pressure (kgf/cm$^2$) | Nozzle-photo-receptor distance | No. of spray |
| Example C1 | 4 | 10 | 2 | 4 | 10 | 2 |
| Example C2 | 4 | 10 | 2 | 4 | 10 | 2 |
| Example C3 | 4 | 10 | 2 | 4 | 10 | 2 |
| Example C4 | 4 | 10 | 2 | 4 | 10 | 2 |
| Example C5 | 4 | 10 | 2 | 4 | 10 | 2 |
| Example C6 | 4 | 10 | 2 | 4 | 10 | 2 |
| Example C7 | 4 | 20 | 2 | 4 | 20 | 2 |
| Example C8 | 4 | 5 | 2 | 4 | 5 | 2 |
| Example C9 | 4 | 15 | 2 | 4 | 15 | 2 |
| Example C10 | 4 | 7 | 2 | 4 | 7 | 2 |
| Example C11 | 4 | 10 | 1 | 4 | 10 | 1 |
| Example C12 | 4 | 10 | 4 | 4 | 10 | 4 |
| Example C13 | 4 | 10 | 2 | 4 | 10 | 2 |
| Example C14 | 4 | 10 | 3 | 4 | 10 | 3 |
| Example C15 | 4 | 20 | 1 | 4 | 20 | 3 |
| Example C16 | 4 | 5 | 3 | 4 | 5 | 1 |
| Example C17 | 4 | 15 | 1 | 4 | 15 | 3 |
| Example C18 | 4 | 7 | 3 | 4 | 7 | 1 |
| Example C19 | 4 | 20 | 1 | 4 | 20 | 2 |
| Example C20 | 6 | 3 | 1 | 6 | 3 | 2 |
| Example C21 | 4 | 20 | 1 | 4 | 20 | 2 |
| Example C22 | 4 | 20 | 1 | 4 | 20 | 2 |
| Example C23 | 4 | 20 | 1 | 4 | 20 | 2 |
| Example C24 | 4 | 10 | 2 | 4 | 10 | 2 |
| Example C25 | 4 | 10 | 2 | 4 | 10 | 2 |
| Comparative Example C1 | 4 | 10 | 2 | 4 | 10 | 2 |
| Comparative Example C2 | — | | | | | |
| Comparative Example C3 | Ref. Spec. | | | | | |

<Filler Observation>

(Determination of r, h1 and h2)

Platinum palladium was coated on a chip of an electrophotographic photoreceptor to impart electroconductivity thereto, and platinum carbon was coated thereon to protect the surface thereof. Thus, a sample was prepared. The cross-section of the sample was modified using a focused ion beam (FIB), and was observed with a thermal FE-SEM. As the FIB apparatus, Quanta 2000 3D from FEI Company Japan Ltd., and as the thermal FE-SEM, ULTRA55 from Carl Zeiss was used.

Figure 7:
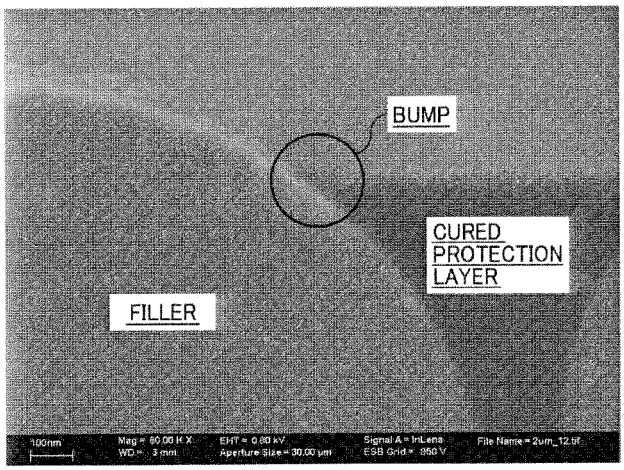
FIG. 7 is a picture of a bump along the surface of the filler projecting from the surface of the cured protection layer in the present invention.
Figure 9:
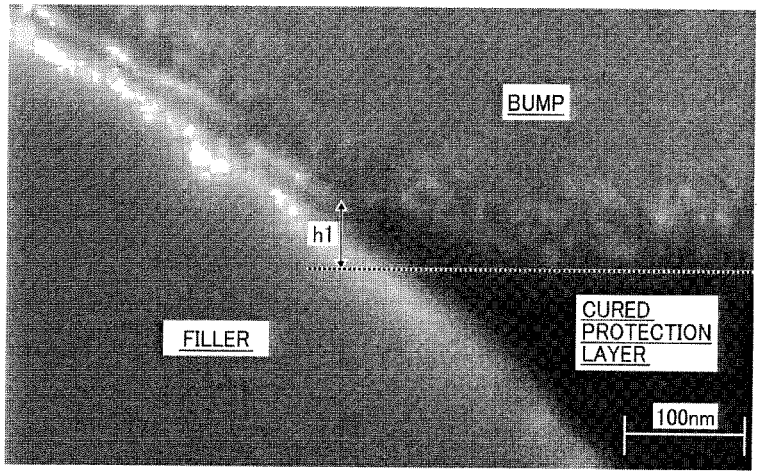
FIG. 9 is a further picture of a bump having a height of h1 along the surface of the filler projecting from the surface of the cured protection layer in the present invention.

Specific examples of cross-sectional images obtained from this observation include FIGS. 7, 8 and 9. A height h1 of a bump surrounding a filler on the cured protection layer, a particle diameter r of the filler and a distance h2 from the bottom of the bump to the highest point of the exposed filler were determined.

r, h1 and h2 are each an average of 100 fillers.

(Determination of S1/(S1+S2))

Platinum palladium was coated on a chip of an electrophotographic photoreceptor to impart electroconductivity thereto. Thus, a sample was prepared. A SEM image of the sample was obtained using a field emission scanning electron microscope S-4200 from Hitachi, Ltd. at an acceleration voltage of 8 kV and 3,000 times. A part of the SEM image where the filler was present and the other part thereof where the filler was not present were digitalized using an image analysis software LMeye from Lasertec Corp. An area the filler occupied S1 and the other area the filler was not present S2 were determined by the same software, and S1/(S1+S2) was determined. Specific example thereof include an SEM image of Example A5 in FIG. 5.

(Determination of Sa/(Sa+Sb))

From the image used for determining S1/(S1+S2), each filler was identified and an area ratio thereof was determined from a difference of electron beam reflection or particle diameter thereof using the image analysis software LMeye from Lasertec Corp.

(Determination of Filler Ratio in Cured Protection Layer)

Figure 11:
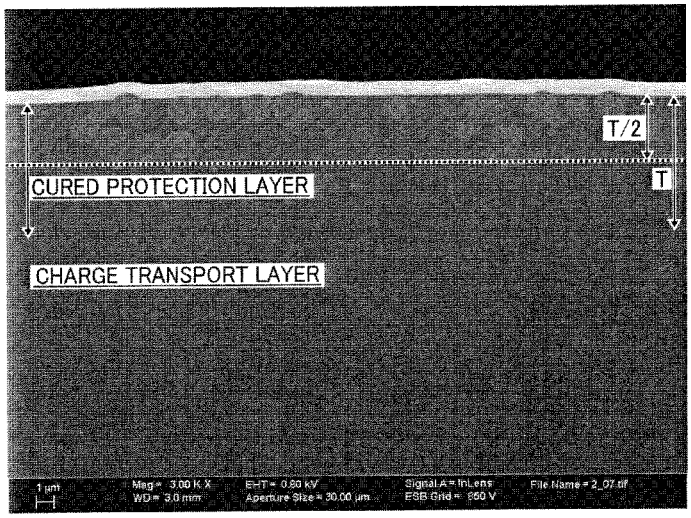
FIG. 11 is a picture showing T/2 and T in the present invention.

A cross-sectional image of 3,000 times was obtained using the apparatus used for determining r, h1 and h2. As FIG. 11 shows, the number of fillers was counted from the cross-sectional image, a filler ratio of the fillers present from the free surface to T/2 was determined from the number and the number of fillers present from the free surface to T/2. Only the fillers present completely over (not contacting) the T/2 line were defined as the fillers present from the free surface to T/2. The content was determined from 10 image data and an average thereof was defined as a filler ratio present from the free surface to T/2.

Examples A1 to A18 and Comparative Examples A1 to A5

| | Filler qty. to T/2 | r/2 (μm) | h1 (μm) | h2 (μm) | 0.015 × r/2 | 0.5 × h2 | S1/(S1 + S2) |
|---|---|---|---|---|---|---|---|
| Example A1 | 77 | 0.25 | 0.028 | 0.31 | 0.004 | 0.155 | 0.33 |
| Example A2 | 71 | 1 | 0.041 | 0.51 | 0.015 | 0.255 | 0.41 |
| Example A3 | 84 | 1.5 | 0.048 | 0.64 | 0.023 | 0.320 | 0.27 |
| Example A4 | 78 | 0.25 | 0.033 | 0.33 | 0.004 | 0.165 | 0.37 |
| Example A5 | 76 | 1 | 0.029 | 0.89 | 0.015 | 0.445 | 0.39 |
| Example A6 | 81 | 1.5 | 0.035 | 1.01 | 0.023 | 0.505 | 0.45 |
| Example A7 | 79 | 1 | 0.013 | 0.71 | 0.015 | 0.355 | 0.31 |
| Example A8 | 81 | 1 | 0.383 | 0.75 | 0.015 | 0.375 | 0.27 |
| Example A9 | 84 | 1 | 0.017 | 0.77 | 0.015 | 0.385 | 0.31 |
| Example A10 | 73 | 1 | 0.452 | 0.84 | 0.015 | 0.420 | 0.27 |
| Example A11 | 76 | 1 | 0.042 | 0.76 | 0.015 | 0.380 | 0.08 |
| Example A12 | 82 | 1 | 0.051 | 0.71 | 0.015 | 0.355 | 0.53 |
| Example A13 | 79 | 1 | 0.039 | 0.88 | 0.015 | 0.440 | 0.12 |
| Example A14 | 77 | 1 | 0.044 | 0.94 | 0.015 | 0.470 | 0.48 |
| Example A15 | 78 | 1 | 0.062 | 0.78 | 0.015 | 0.390 | 0.35 |
| Example A16 | 83 | 1 | 0.043 | 0.55 | 0.015 | 0.275 | 0.37 |
| Example A17 | 85 | 1.5 | 0.054 | 0.69 | 0.023 | 0.345 | 0.40 |
| Example A18 | 74 | 1.5 | 0.033 | 0.88 | 0.023 | 0.440 | 0.39 |
| Comparative Example A1 | 100 | 1 | None | 0.55 | 0.015 | 0.275 | 0.27 |
| Comparative Example A2 | 74 | 1 | 0.037 | 0.89 | 0.015 | 0.445 | 0.33 |
| Comparative Example A3 | 3 | No exposed filler | | | | | |
| Comparative Example A4 | 47 | No exposed filler | | | | | |
| Comparative Example A5 | 65 | 1 | 0.33 | 1.03 | 0.015 | 0.515 | 0.39 |

Examples B1 to B20 and Comparative Examples B1 to B4

| | Filler qty. to T/2 | r/2 (μm) | h1 (μm) | h2 (μm) | 0.015 × r/2 | 0.5 × h2 | S1/(S1 + S2) |
|---|---|---|---|---|---|---|---|
| Example B1 | 71 | 0.25 | 0.025 | 0.307 | 0.004 | 0.153 | 0.33 |
| Example B2 | 77 | 1 | 0.037 | 0.505 | 0.015 | 0.252 | 0.41 |
| Example B3 | 74 | 1.5 | 0.043 | 0.634 | 0.023 | 0.317 | 0.27 |
| Example B4 | 81 | 0.25 | 0.030 | 0.327 | 0.004 | 0.163 | 0.37 |
| Example B5 | 79 | 1 | 0.026 | 0.881 | 0.015 | 0.441 | 0.39 |
| Example B6 | 78 | 1.5 | 0.032 | 1.000 | 0.023 | 0.500 | 0.45 |

-continued

| | Filler qty. to T/2 | r/2 (μm) | h1 (μm) | h2 (μm) | 0.015 × r/2 | 0.5 × h2 | S1/(S1 + S2) |
|---|---|---|---|---|---|---|---|
| Example B7 | 75 | 1 | 0.013 | 0.710 | 0.015 | 0.355 | 0.31 |
| Example B8 | 70 | 1 | 0.383 | 0.750 | 0.015 | 0.375 | 0.27 |
| Example B9 | 71 | 1 | 0.017 | 0.770 | 0.015 | 0.385 | 0.31 |
| Example B10 | 78 | 1 | 0.410 | 0.840 | 0.015 | 0.420 | 0.27 |
| Example B11 | 81 | 1 | 0.038 | 0.752 | 0.015 | 0.376 | 0.08 |
| Example B12 | 85 | 1 | 0.046 | 0.703 | 0.015 | 0.351 | 0.53 |
| Example B13 | 86 | 1 | 0.035 | 0.871 | 0.015 | 0.436 | 0.12 |
| Example B14 | 75 | 1 | 0.040 | 0.931 | 0.015 | 0.465 | 0.48 |
| Example B15 | 78 | 1 | 0.056 | 0.772 | 0.015 | 0.386 | 0.35 |
| Example B16 | 74 | 1 | 0.039 | 0.545 | 0.015 | 0.272 | 0.37 |
| Example B17 | 73 | 1.5 | 0.049 | 0.683 | 0.023 | 0.342 | 0.40 |
| Example B18 | 72 | 1.5 | 0.030 | 0.871 | 0.023 | 0.436 | 0.39 |
| Example B19 | 88 | 1 | 0.052 | 0.634 | 0.015 | 0.317 | 0.29 |
| Example B20 | 86 | 1 | 0.042 | 0.436 | 0.015 | 0.218 | 0.31 |

-continued

| | Filler qty. to T/2 | r/2 (μm) | h1 (μm) | h2 (μm) | 0.015 × r/2 | 0.5 × h2 | S1/(S1 + S2) |
|---|---|---|---|---|---|---|---|
| Comparative Example B1 | 100 | 1 | None | 1.955 | 0.015 | 0.978 | 0.27 |
| Comparative Example B2 | 74 | 1 | 0.37 | 0.890 | 0.015 | 0.445 | 0.33 |
| Comparative Example B3 | 54 | No exposed filler | | | | | |
| Comparative Example B4 | 48 | No exposed filler | | | | | |

Examples C1 to C25 and Comparative Examples C1 to C3

| | Filler | Exposed filler 1 | | | Exposed filler 2 | | |
|---|---|---|---|---|---|---|---|
| | qty. to T/2 | r/2 (μm) | h1 (μm) | h2 (μm) | r/2 (μm) | h1 (μm) | h2 (μm) |
| Example C1 | 89 | 0.25 | 0.024 | 0.119 | 0.125 | 0.039 | 0.145 |
| Example C2 | 94 | 1 | 0.035 | 0.480 | 0.75 | 0.088 | 0.555 |
| Example C3 | 91 | 1.5 | 0.041 | 0.602 | 0.125 | 0.114 | 0.590 |
| Example C4 | 92 | 0.25 | 0.028 | 0.144 | 0.35 | 0.077 | 0.305 |
| Example C5 | 91 | 1 | 0.025 | 0.596 | 0.75 | 0.097 | 0.568 |
| Example C6 | 90 | 1.5 | 0.030 | 0.950 | 0.125 | 0.019 | 0.122 |
| Example C7 | 87 | 1 | 0.013 | 0.675 | 0.75 | 0.088 | 0.650 |
| Example C8 | 89 | 1 | 0.364 | 0.713 | 0.75 | 0.098 | 0.710 |
| Example C9 | 91 | 1 | 0.016 | 0.732 | 0.75 | 0.078 | 0.722 |
| Example C10 | 84 | 1 | 0.397 | 0.798 | 0.75 | 0.094 | 0.691 |
| Example C11 | 72 | 1 | 0.036 | 0.121 | 0.75 | 0.022 | 0.655 |
| Example C12 | 95 | 1 | 0.044 | 0.102 | 0.75 | 0.033 | 0.705 |
| Example C13 | 73 | 1 | 0.033 | 0.136 | 0.75 | 0.044 | 0.644 |
| Example C14 | 91 | 1 | 0.038 | 0.144 | 0.75 | 0.028 | 0.688 |
| Example C15 | 89 | 1 | 0.055 | 0.135 | 0.75 | 0.019 | 0.618 |
| Example C16 | 91 | 1 | 0.066 | 0.166 | 0.75 | 0.023 | 0.666 |
| Example C17 | 97 | 1 | 0.049 | 0.997 | 0.75 | 0.036 | 0.657 |
| Example C18 | 91 | 1 | 0.044 | 0.125 | 0.75 | 0.028 | 0.649 |
| Example C19 | 70 | 1 | 0.010 | 0.087 | 1 | 0.058 | 0.909 |
| Example C20 | 73 | 1 | 0.013 | 0.094 | 1 | 0.074 | 0.975 |
| Example C21 | 72 | 1 | 0.011 | 0.084 | 1 | 0.066 | 0.940 |
| Example C22 | 93 | 1 | 0.014 | 0.533 | 0.75 | 0.044 | 0.650 |
| Example C23 | 94 | 1.5 | 0.094 | 0.748 | 0.75 | 0.039 | 0.647 |
| Example C24 | 89 | 0.25 | 0.024 | 0.109 | 1 | 0.039 | 0.488 |
| Example C25 | 78 | 0.25 | 0.033 | 0.136 | 0.125 | 0.048 | 0.155 |
| Comparative Example C1 | 89 | 0.25 | 0.034 | 0.107 | 0.35 | 0.064 | 0.297 |
| Comparative Example C2 | 47 | No Exposed Filler | | | | | |
| Comparative Example C3 | 100 | 1 | None | 0.033 | 0.75 | None | 0.024 |

| | Exposed filler 1 | | Exposed filler 2 | | | |
|---|---|---|---|---|---|---|
| | 0.015 × r/2 | 0.5 × h2 | 0.015 × r/2 | 0.5 × h2 | S1/(S1 + S2) | Sa/(Sa + Sb) |
| Example C1 | 0.004 | 0.050 | 0.002 | 0.073 | 0.33 | 0.51 |
| Example C2 | 0.015 | 0.240 | 0.011 | 0.278 | 0.41 | 0.58 |
| Example C3 | 0.023 | 0.301 | 0.002 | 0.295 | 0.27 | 0.49 |
| Example C4 | 0.004 | 0.072 | 0.005 | 0.153 | 0.37 | 0.55 |
| Example C5 | 0.015 | 0.298 | 0.011 | 0.284 | 0.39 | 0.56 |
| Example C6 | 0.023 | 0.475 | 0.002 | 0.061 | 0.45 | 0.47 |
| Example C7 | 0.015 | 0.337 | 0.011 | 0.325 | 0.31 | 0.51 |
| Example C8 | 0.015 | 0.356 | 0.011 | 0.355 | 0.27 | 0.58 |
| Example C9 | 0.015 | 0.366 | 0.011 | 0.361 | 0.31 | 0.47 |
| Example C10 | 0.015 | 0.399 | 0.011 | 0.346 | 0.27 | 0.44 |
| Example C11 | 0.015 | 0.061 | 0.011 | 0.328 | 0.08 | 0.51 |
| Example C12 | 0.015 | 0.051 | 0.011 | 0.353 | 0.53 | 0.58 |
| Example C13 | 0.015 | 0.068 | 0.011 | 0.322 | 0.12 | 0.47 |
| Example C14 | 0.015 | 0.072 | 0.011 | 0.344 | 0.48 | 0.50 |
| Example C15 | 0.015 | 0.068 | 0.011 | 0.309 | 0.27 | 0.28 |

-continued

| | | | | | | |
|---|---|---|---|---|---|---|
| Example C16 | 0.015 | 0.083 | 0.011 | 0.333 | 0.31 | 0.73 |
| Example C17 | 0.015 | 0.499 | 0.011 | 0.329 | 0.25 | 0.31 |
| Example C18 | 0.015 | 0.063. | 0.011 | 0.32 | 0.28 | 0.68 |
| Example C19 | 0.015 | 0..044 | 0.015 | 0.455 | 0.09 | 0.27 |
| Example C20 | 0.015 | 0.047 | 0.015 | 0.488 | 0.52 | 0.25 |
| Example C21 | 0.015 | 0.042 | 0.015 | 0.470 | 0.08 | 0.26 |
| Example C22 | 0.015 | 0.267 | 0.011 | 0.325 | 0.08 | 0.28 |
| Example C23 | 0.023 | 0.374 | 0.011 | 0.324 | 0.08 | 0.29 |
| Example C24 | 0.004 | 0.055 | 0.015 | 0.244 | 0.31 | 0.47 |
| Example C25 | 0.004 | 0.068 | 0.002 | 0.078 | 0.36 | 0.47 |
| Comparative Example C1 | 0.004 | 0.054 | 0.005 | 0.149 | 0.33 | 0.44 |
| Comparative Example C2 | — | — | — | — | — | — |
| Comparative Example C3 | 0.015 | 0.017 | 0.011 | 0.012 | 0.75 | 0.36 |

Toner transferability, layer abrasion amount and images were evaluated using the above-mentioned photoreceptors.

Each of the photoreceptors was installed in a process cartridge, the process cartridge was installed in modified imagio MP C 5000 from Ricoh Company, Ltd., and 100,000 and 300,000 monochrome black images (A4 My Paper from NBS Ricoh Co., Ltd. having an image area ratio of 5% chart) were produced in Examples and Comparative Examples A, and Examples B&C and Comparative Examples B&C, respectively. The Toner transferability, layer abrasion amount and images were evaluated before and after the image production. A lubricant was removed from a cartridge of imagio MP C 5000.

The transferability was determined using the following formula.

Transferability=1−(untransferred toner ratio)=1−(untransferred toner *M/A*)/toner *M/A* before transferred)

The untransferred toner is a toner remaining on a photoreceptor after transferred onto a paper.

M/A is a weight of a toner adhering to a photoreceptor per unit area ($mg/cm^2$).

A transferability evaluation chart having lined solid images of 2 $cm^2$ was produced to transfer a toner on a photoreceptor onto a transfer paper. When the apparatus is stopped just after the toner is transferred, an untransferred toner remains on the photoreceptor. The untransferred toner is peeled with an adhesive tape to determine the untransferred toner M/A on the photoreceptor. A coefficient was determined from a plot of the untransferred toner ID (Image Density) and the toner amount, and the untransferred toner M/A was determined from the untransferred toner ID. The toner M/A before transferred was determined from the toner amount before transferred on the photoreceptor.

The photoreceptor was removed after the images were produced, and the abrasion amount was measured from a difference of layer thickness of the photoreceptor before and after the production. The thickness was measured using Fischer Scope MMS from Fischer Instruments K.K.

A test chart No. 3 from Image Society of Japan was produced before and after the production to visually evaluate image quality under the following standards.

4: Almost no deterioration of image quality

3: Image quality slightly deteriorates, but no problem in visual observation

2: Deterioration of image quality is identifiable even in visual observation

1: Serious problem in image quality

The results are shown in the following Tables.

| | Before Transfer-ability (%) | After Transfer-ability (%) | After Abrasion amount (μm) | Before Image rank | After Image rank |
|---|---|---|---|---|---|
| Example A1 | 98.4 | 97.9 | 0.1 | 4 | 4 |
| Example A2 | 98.1 | 97.6 | 0.2 | 4 | 4 |
| Example A3 | 97.5 | 97.0 | 0.3 | 4 | 4 |
| Example A4 | 97.5 | 97.0 | 0.1 | 4 | 4 |
| Example A5 | 98.2 | 97.7 | 0.2 | 4 | 4 |
| Example A6 | 97.9 | 97.4 | 0.3 | 4 | 4 |
| Example A7 | 93.8 | 93.3 | 0.4 | 4 | 3 |
| Example A8 | 92.5 | 92.0 | 0.3 | 4 | 3 |
| Example A9 | 94.5 | 93.7 | 0.5 | 4 | 3 |
| Example A10 | 96.5 | 96.1 | 0.3 | 3 | 3 |
| Example A11 | 94.5 | 94.9 | 0.5 | 4 | 3 |
| Example A12 | 96.9 | 96.1 | 0.3 | 4 | 3 |
| Example A13 | 92.9 | 93.6 | 0.5 | 4 | 3 |
| Example A14 | 96.5 | 96.1 | 0.3 | 4 | 3 |
| Example A15 | 96.2 | 96.7 | 0.3 | 4 | 4 |
| Example A16 | 97.1 | 97.4 | 0.4 | 4 | 4 |
| Example A17 | 98.4 | 97.4 | 0.3 | 4 | 4 |
| Example A18 | 97.8 | 97.4 | 0.3 | 4 | 4 |
| Comparative Example A1 | 92.1 | 89.9 | 0.6 | 4 | 2 |
| Comparative Example A2 | 94.0 | 90.4 | 0.6 | 4 | 2 |
| Comparative Example A3 | 81.9 | 90.5 | 0.6 | 2 | 2 |
| Comparative Example A4 | 91.1 | 88.9 | 0.7 | 2 | 2 |
| Comparative Example A5 | 93.9 | 88.8 | 0.8 | 3 | 1 |

Comparative Example A1 (a filler was driven in the protection layer after cured) did not form a bump around the filler and did not firmly keep the filler. Comparative Example A2 has a protection layer including a bifunctional group, and did not firmly keep the filler. Comparative Examples A3 and A4 have many fillers buried in their layers, and their bright space potentials increase. Comparative Examples A5 is not a crosslinked type (uncured protection layer+powder coating), and did not firmly keep the filler.

| | Before Transfer-ability (%) | After Transfer-ability (%) | After Abrasion amount (μm) | Before Image rank | After Image rank |
|---|---|---|---|---|---|
| Example B1 | 98.9 | 98.4 | 0.1 | 4 | 4 |
| Example B2 | 98.6 | 98.1 | 0.2 | 4 | 4 |

-continued

| | Before Transfer-ability (%) | After Transfer-ability (%) | After Abrasion amount (μm) | Before Image rank | After Image rank |
|---|---|---|---|---|---|
| Example B3 | 98.0 | 97.5 | 0.1 | 4 | 4 |
| Example B4 | 98.0 | 97.5 | 0.1 | 4 | 4 |
| Example B5 | 98.7 | 98.2 | 0.1 | 4 | 4 |
| Example B6 | 98.4 | 97.9 | 0.1 | 4 | 4 |
| Example B7 | 94.3 | 93.8 | 0.4 | 4 | 3 |
| Example B8 | 93.0 | 92.5 | 0.3 | 4 | 3 |
| Example B9 | 95.0 | 93.7 | 0.4 | 4 | 3 |
| Example B10 | 97.0 | 96.1 | 0.3 | 4 | 3 |
| Example B11 | 95.0 | 94.9 | 0.4 | 3 | 3 |
| Example B12 | 97.4 | 96.1 | 0.3 | 4 | 3 |
| Example B13 | 93.4 | 93.6 | 0.4 | 4 | 3 |
| Example B14 | 97.0 | 96.1 | 0.2 | 4 | 3 |
| Example B15 | 96.7 | 96.7 | 0.2 | 4 | 4 |
| Example B16 | 97.6 | 97.4 | 0.3 | 4 | 4 |
| Example B17 | 98.9 | 97.4 | 0.3 | 4 | 4 |
| Example B18 | 98.3 | 97.4 | 0.3 | 4 | 4 |
| Example B19 | 98.1 | 97.4 | 0.2 | 4 | 4 |
| Example B20 | 97.8 | 97.1 | 0.2 | 4 | 4 |
| Comparative Example B1 | 92.6 | 89.9 | 0.4 | 4 | 2 |
| Comparative Example B2 | 94.5 | 90.4 | 0.4 | 4 | 2 |
| Comparative Example B3 | 93.3 | 90.5 | −0.2 | 4 | 1 |
| Comparative Example B4 | 94.4 | 88.8 | 0.3 | 2 | 1 |

Comparative Example B1 (a filler was driven in the protection layer after cured) did not form a bump around the filler and did not firmly keep the filler. Comparative Example B2 has a protection layer including a bifunctional group, and did not firmly keep the filler. Comparative Example B3 in which a filler dispersion was coated had poor surface releasability although having high mechanical durability, and produced abnormal images due to adherence of foreign particles. Comparative Example B3 in which two filler dispersions were coated increased bright space potential and produced images having low image density from the beginning because the filler coated in a protection layer became a charge trap.

| | Before Transfer-ability (%) | After Transfer-ability (%) | After Abrasion amount (μm) | Before Image rank | After Image rank |
|---|---|---|---|---|---|
| Example C1 | 97.9 | 98.4 | 0.1 | 4 | 4 |
| Example C2 | 98.8 | 98.2 | 0.2 | 4 | 4 |
| Example C3 | 97.9 | 97.4 | 0.1 | 4 | 4 |
| Example C4 | 98.5 | 98.0 | 0.2 | 4 | 4 |
| Example C5 | 97.8 | 97.3 | 0.2 | 4 | 4 |
| Example C6 | 98.4 | 97.9 | 0.1 | 4 | 4 |
| Example C7 | 93.1 | 92.2 | 0.5 | 4 | 4 |
| Example C8 | 93.3 | 93.7 | 0.5 | 4 | 4 |
| Example C9 | 94.5 | 94.6 | 0.5 | 4 | 4 |
| Example C10 | 95.5 | 94.9 | 0.4 | 4 | 4 |
| Example C11 | 95.5 | 93.5 | 0.6 | 4 | 4 |
| Example C12 | 96.1 | 94.5 | 0.5 | 4 | 4 |
| Example C13 | 94.6 | 95.0 | 0.6 | 4 | 4 |
| Example C14 | 96.4 | 94.5 | 0.3 | 4 | 3 |
| Example C15 | 94.8 | 94.3 | 0.4 | 4 | 4 |
| Example C16 | 95.5 | 94.3 | 0.5 | 4 | 4 |
| Example C17 | 96.5 | 94.9 | 0.4 | 4 | 4 |
| Example C18 | 97.2 | 95.0 | 0.3 | 4 | 4 |
| Example C19 | 92.1 | 92.2 | 0.7 | 4 | 4 |
| Example C20 | 92.1 | 92.3 | 0.6 | 4 | 4 |
| Example C21 | 93.3 | 92.5 | 0.7 | 4 | 4 |
| Example C22 | 93.1 | 93.8 | 0.5 | 4 | 4 |
| Example C23 | 93.8 | 94.0 | 0.6 | 4 | 4 |

-continued

| | Before Transfer-ability (%) | After Transfer-ability (%) | After Abrasion amount (μm) | Before Image rank | After Image rank |
|---|---|---|---|---|---|
| Example C24 | 94.5 | 93.3 | 0.4 | 4 | 4 |
| Comparative Example C1 | 91.3 | 88.7 | 1.1 | 4 | 2 |
| Comparative Example C2 | 91.0 | 89.4 | 0.5 | 2 | 1 |
| Comparative Example C3 | 91.1 | 88.4 | 0.7 | 3 | 2 |

Comparative Example C1 has a protection layer including a bifunctional group, and did not firmly keep the filler. Comparative Example C2 in which two filler dispersions were coated increased bright space potential and produced images having low image density from the beginning because the filler coated in a protection layer became a charge trap. Comparative Example C3 (a filler was driven in the protection layer after cured) did not form a bump around the filler and did not firmly keep the filler.

What is claimed is:

1. An electrophotographic photoreceptor, comprising:

an electroconductive substrate;

a photosensitive layer, overlying the substrate; and a cured protection layer, overlying the photosensitive layer, wherein the cured protection layer comprises a cured material of a tri- or more functional radical polymerizable compound and a filler exposed from the surface of the cured protection layer which comprises a bump along the surface of the filler, and wherein the cured protection layer has a thickness (T) larger than a diameter (2r) of the filler therein and the following relationships (a) is satisfied:

$$(\text{the number of the fillers present to a depth of } T/2 \text{ from a free surface of the cured protection layer/ the total number of the fillers in the cured protection layer})\times 100 \geq 7\% \quad \text{(a).}$$

2. The electrophotographic photoreceptor of claim 1, wherein the bump satisfies the following relationship:

$$0.015\times r/2 \leq h1 \leq 0.5\times h2 \quad \text{(b)}$$

wherein r is a particle diameter of the filler, h1 is a maximum height of the bump covering the filler from the bottom of the bump, and h2 is a distance from the bottom thereof to the highest point of the exposed part of the filler.

3. The electrophotographic photoreceptor of claim 1, wherein the cured protection layer satisfies the following relationship:

$$0.10 \leq S1/(S1+S2) \leq 0.50 \quad \text{(c)}$$

wherein S1 is a projection area of the filler having a part which is not covered by the cured protection layer and S2 is a projection area of a part where the filler is not present.

4. The electrophotographic photoreceptor of claim 1, wherein the cured protection layer further comprises a filler covered thereby.

5. The electrophotographic photoreceptor of claim 4, wherein the filler covered by the cured protection layer is an alumina filler.

6. The electrophotographic photoreceptor of claim 1, wherein the filler exposed from the surface of the cured protection layer comprises a first filler and a second filler formed of a material different from that of the first filler.

7. The electrophotographic photoreceptor of claim 6, wherein the first filler is an organic filler comprising a silicon atom or a fluorine atom, and the second filler is a metal oxide filler.

8. The electrophotographic photoreceptor of claim 7, wherein the cured protection layer satisfies the following relationship:

$$0.3 \leq Sa/(Sa+Sb) \leq 0.7 \quad \text{(d)}$$

wherein Sa is a projection area of the organic filler comprising a silicon or a fluorine atom and Sb is a projection area of at least one metal oxide filler when the cured protection layer is projected from above.

9. The electrophotographic photoreceptor of claim 1, wherein the cured protection layer further comprises a cured material of a radical polymerizable compound having a charge transport structure and a tri- or more radical polymerizable compound.

10. The electrophotographic photoreceptor of claim 1, wherein the cured protection layer is formed by applying a cured protection layer coating liquid, coating a filler, and curing the liquid.

11. A method of preparing the electrophotographic photoreceptor of claim 1, comprising:

forming a photosensitive layer on an electroconductive substrate;

applying a cured protection layer coating liquid on the photosensitive layer;

coating a filler on the cured protection layer; and curing the cured protection layer coating liquid.

12. An image forming apparatus, comprising:

the electrophotographic photoreceptor according to claim 1;

a charger configured to charge the electrophotographic photoreceptor;

an irradiator configured to irradiate the electrophotographic photoreceptor to form an electrostatic latent image thereon;

an image developer configured to develop the electrostatic latent image with a toner to form a toner image; and a transferer configured to transfer the toner image onto a transfer paper.

13. A process cartridge for image forming apparatus, comprising:

the electrophotographic photoreceptor according to claim 1; and at least one of a charger, an irradiator, an image developer, a transferer and a cleaner.

* * * * *